US008154566B2

(12) United States Patent
Toyomura et al.

(10) Patent No.: US 8,154,566 B2
(45) Date of Patent: Apr. 10, 2012

(54) ACTIVE-MATRIX DISPLAY APPARATUS DRIVING METHOD OF THE SAME AND ELECTRONIC INSTRUMENTS

(75) Inventors: Naobumi Toyomura, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 452 days.

(21) Appl. No.: 12/458,564

(22) Filed: Jul. 16, 2009

(65) Prior Publication Data

US 2010/0026729 A1 Feb. 4, 2010

(30) Foreign Application Priority Data

Jul. 29, 2008 (JP) ..... 2008-194343

(51) Int. Cl.
*G09G 5/10* (2006.01)

(52) U.S. Cl. ..... 345/690; 345/76; 345/77; 345/89

(58) Field of Classification Search ..... 345/76–82, 345/87–100, 204–215, 690
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,229,508 | B1 * | 5/2001 | Kane | 345/82 |
| 6,356,026 | B1 * | 3/2002 | Murto | 315/111.81 |
| 6,693,388 | B2 * | 2/2004 | Oomura | 315/169.3 |
| 2008/0062096 | A1 | 3/2008 | Yamashita et al. | |

FOREIGN PATENT DOCUMENTS

| | | | |
|---|---|---|---|
| JP | 2001-257080 | A | 9/2001 |
| JP | 2003-233329 | A | 8/2003 |
| JP | 2003-280593 | A | 10/2003 |
| JP | 2005-085737 | A | 3/2005 |
| JP | 2005-352398 | A | 12/2005 |
| JP | 2006-330469 | A | 12/2006 |
| JP | 2007-041574 | A | 2/2007 |
| JP | 2008-065200 | | 3/2008 |

OTHER PUBLICATIONS

Japanese Office Action issued Jul. 13, 2010 for corresponding Japanese Application No. 2008-194343.
Japanese Office Action issued Jun. 9, 2011 for corresponding Japanese Application No. 2008-194343.

* cited by examiner

*Primary Examiner* — Vijay Shankar
(74) *Attorney, Agent, or Firm* — Rader, Fishman & Grauer PLLC

(57) ABSTRACT

Disclosed herein is an active-matrix display apparatus, wherein if any particular one of N light emitting sub-devices pertaining to any specific one of pixel circuits is defective, the particular light emitting sub-device is electrically disconnected from the specific pixel circuit and the magnitude of a driving current supplied to the (N−1) remaining light emitting sub-devices pertaining to the specific pixel circuit is adjusted so that the (N−1) remaining light emitting sub-devices receive a driving current from a device driving transistor with a magnitude suppressed to a value equal to ((N−1)/N) times the magnitude of a driving current which is supplied to a normal pixel circuit not including a defective light emitting sub-device.

5 Claims, 17 Drawing Sheets

(1)

(2), (3)

(4)

(5)

(6)

(7)

ACTIVE-MATRIX DISPLAY APPARATUS DRIVING METHOD OF THE SAME AND ELECTRONIC INSTRUMENTS

BACKGROUND OF THE INVENTION

1. Field of the Invention

The present invention relates to an active-matrix display apparatus employing light emitting devices such as organic EL (Electro Luminescence) devices which are each included in a pixel circuit and also relates to a driving method of the active-matrix display apparatus. To put it in more detail, the present invention relates to improvements of a technology for fixing defects of an image displayed by the active-matrix display apparatus. The present invention also relates to an electronic instrument which employs the active-matrix display apparatus.

2. Description of the Related Art

As a contemporary planar display apparatus, an organic EL display apparatus draws attention. This organic EL display apparatus employs self-light-emitting devices which are each included in a pixel circuit. Thus, the organic EL display apparatus can be designed as an apparatus which offers a wide viewing angle, requires no backlight and has a small thickness. In addition, since the organic EL display apparatus does not require a backlight, the power consumption of the apparatus can be reduced by the apparatus. On top of that, the organic EL display apparatus offers a high response speed.

The organic EL display apparatus employs organic EL devices laid out to form a two-dimensional matrix. Each of the organic EL devices is made of an organic light emitting layer which has a light emitting function. The organic light emitting layer is provided over a substrate and sandwiched between the anode and cathode electrodes of the organic EL device.

In a process of creating the organic EL device, infinitesimal foreign things and the like, which are floating in the air, may be stuck between the anode and cathode electrodes of the organic EL device, resulting in a short-circuit defect which makes the organic EL device incapable of emitting light. The short-circuit defect making the organic EL device incapable of emitting light is recognized as a death-point fault. A technology for fixing an organic EL device having such a death-point fault has been developed in development activities which started in the past. Such a technology is disclosed in materials such as Japanese Patent Laid-Open No. 2008-065200 (hereinafter referred to as Patent Document 1).

The active-matrix display apparatus disclosed in Patent Document 1 employs scan lines, signal lines and pixel circuits laid out to form a two-dimensional matrix. Each used for supplying a control signal to the pixel circuits, the scan lines each form a row of the two-dimensional matrix. Each used for supplying a video signal to the pixel circuits, the signal lines each form a column of the two-dimensional matrix. Each of the pixel circuits is located at the intersection of one of the scan lines and one of the signal lines. The scan lines, the signal lines and the pixel circuits are formed on a substrate. Every pixel circuit has a signal sampling transistor for sampling a video signal with a timing determined by the control signal. In addition, every pixel circuit has a device driving transistor for generating a driving current with a magnitude according to the video signal sampled by the signal sampling transistor. On top of that, every pixel circuit has a light emitting device for receiving the driving current from the device driving transistor and emitting light at a luminance level according to the driving current. That is to say, the light emitting device emits light at a luminance level according to the video signal which has been sampled by the signal sampling transistor. The light emitting device is a thin-film device having two terminals. That is to say, the light emitting device has a pair of electrodes which are referred to as an anode and a cathode. In addition, the light emitting device also includes a light emitting layer which is sandwiched by the anode and the cathode. At least one of the two electrodes are divided into a plurality of portions so that the light emitting device itself is virtually divided into a plurality of light emitting sub-devices. The light emitting sub-devices receive the driving current from the device driving transistor and, as a whole, emit light at a luminance level according to the driving current. Since the magnitude of the driving current is determined by the magnitude of the video signal sampled by the signal sampling transistor, as a whole, the light emitting sub-devices emit light at a luminance level according to the video signal. If one of the light emitting sub-devices is defective, this defective light emitting sub-device is electrically disconnected from the pixel circuit and the driving current is supplied to the remaining light emitting sub-devices. Thus, the remaining light emitting sub-devices are capable of sustaining the process of emitting light at a luminance level according to the video signal.

In the case of the active-matrix display apparatus disclosed in Patent Document 1, the light emitting device employed in every pixel circuit is divided into a plurality of light emitting sub-devices in advance. For example, the light emitting device employed in every pixel circuit is divided into a pair of light emitting sub-devices in advance. If one of the two light emitting sub-devices has a short-circuit defect, the defective light emitting sub-device is electrically disconnected from the pixel circuit. In this way, the pixel circuit having the death-point fault can be fixed. The probability that both the light emitting sub-devices become short-circuit defective at the same time is extremely low. Both the light emitting sub-devices become short-circuit defective at the same time because, for example, a foreign thing or the like is stuck on both the light emitting sub-devices.

Normally, only one of the two light emitting sub-devices becomes short-circuit defective. If the two light emitting sub-devices are kept as they are, however, the flowing driving current will be concentrated on the light emitting sub-device which has become short-circuit defective. Thus, both the light emitting sub-devices do not emit light so that a death-point fault is generated in the pixel circuit which employs the light emitting sub-devices. In order to solve this problem, the light emitting sub-device becoming short-circuit defective is electrically disconnected from the pixel circuit employing the defective light emitting sub-device and the driving current is supplied to the remaining the light emitting sub-device. In this way, the pixel circuit having the death-point fault can be fixed.

SUMMARY OF THE INVENTION

Even if a pixel circuit is fixed by detaching a light emitting sub-device having a short-circuit defect from the pixel circuit, the driving current flowing through the fixed pixel circuit has a magnitude equal to the magnitude of a current flowing through a pixel circuit which does not have a death-point fault. In this invention specification, a pixel circuit fixed by detaching a light emitting sub-device having a short-circuit defect from the pixel circuit is referred to as a fixed pixel circuit. On the other hand, a pixel circuit which does not have a death-point fault is referred to as a normal pixel circuit in this invention specification. Since the driving current flowing through a fixed pixel circuit has a magnitude equal to the magnitude of a current flowing through a normal pixel circuit, light emitted by the fixed pixel circuit has a luminance level equal to the luminance level of light emitted by the normal pixel circuit. Thus, there is no apparent difference between the fixed pixel circuit and the normal pixel circuit.

Nevertheless, there is raised a problem that deterioration of the luminance of light emitted by a fixed pixel circuit worsens with the lapse of time in comparison with deterioration of the luminance of light emitted by a normal pixel circuit. That is to say, the deterioration of the luminance of light emitted by a fixed pixel circuit worsens at a high speed in comparison with the deterioration of the luminance of light emitted by a normal pixel circuit. In general, the luminance of light emitted by a light emitting device tends to deteriorate with the lapse of time without regard to whether the pixel circuit employing the light emitting device is a fixed or normal pixel circuit. In this invention specification, the deterioration of the luminance of light emitted by a light emitting device with the lapse of time is referred to as luminance deterioration. The deterioration of the luminance of light emitted by a fixed pixel circuit worsens at a high speed in comparison with the deterioration of the luminance of light emitted by a normal pixel circuit for a reason described as follows. Since a light emitting sub-device becoming short-circuit defective is electrically disconnected from the fixed pixel circuit employing the light emitting sub-device, the density of the driving current flowing through the remaining light emitting sub-device employed in the fixed pixel circuit is higher than the density of the driving current flowing through each of the light emitting sub-devices which are employed in the normal pixel circuit. The higher the density of the driving current, the higher the speed of the progress of the luminance deterioration. As a result, the luminance deterioration progresses in a fixed pixel circuit at a speed higher than the speed of the progress of the luminance deterioration in a normal pixel circuit. In other words, the difference in luminance between a fixed pixel circuit and a normal pixel circuit increases much as time goes by. Finally, at a certain point, there is raised a problem that a voltage applied to a light emitting sub-device employed in the fixed pixel circuit is reduced to a magnitude not greater than the threshold voltage of the light emitting sub-device so that a death-point fault is generated in the light emitting device.

Addressing the technological problems described above, inventors of the present invention have innovated an active-matrix display apparatus which is capable of restraining the progress of the luminance deterioration of a fixed pixel circuit. In order to make the active-matrix display apparatus capable of restraining the progress of the luminance deterioration of a fixed pixel circuit, the active-matrix display apparatus is provided with sections described below. That is to say, the active-matrix display apparatus provided by an embodiment of the present invention employs scan lines, signal lines and pixel circuits laid out to form a two-dimensional matrix of a pixel array section. The scan lines, the signal lines and the pixel circuits are described as follows:

Each used for supplying a control signal to the pixel circuits, the scan lines each form a row of the two-dimensional matrix;

each used for supplying a video signal to the pixel circuits, the signal lines each form a column of the two-dimensional matrix;

each of the pixel circuits is located at the intersection of one of the scan lines and one of the signal lines;

the scan lines, the signal lines and the pixel circuits are formed on a substrate;

each of the pixel circuit has a signal sampling transistor for sampling a video signal with a timing determined by the control signal;

each of the pixel circuits has a device driving transistor for generating a driving current with a magnitude according to the video signal sampled by the signal sampling transistor;

each of the pixel circuits has a signal holding capacitor for storing the video signal sampled by the signal sampling transistor;

each of the pixel circuits has a light emitting device for receiving the driving current from the device driving transistor and emitting light at a luminance level according to the driving current which is determined by the video signal sampled by the signal sampling transistor;

the light emitting device is a thin-film device having two terminals serving as a pair of electrodes which are referred to as an anode and a cathode;

the light emitting device also includes a light emitting layer which is sandwiched by the anode and the cathode;

at least one of the two electrodes are divided into N portions so that the light emitting device is virtually divided into N light emitting sub-devices;

the N light emitting sub-devices receive the driving current from the device driving transistor and, as a whole, emit light at a luminance level according to the driving current which is determined by the video signal sampled by the signal sampling transistor; and if any particular one of the N light emitting sub-devices pertaining to any specific one of the pixel circuits is defective, the particular light emitting sub-device is electrically disconnected from the specific pixel circuit and the magnitude of the driving current supplied to the (N−1) remaining light emitting sub-devices pertaining to the specific pixel circuit is adjusted so that the (N−1) remaining light emitting sub-devices receive a driving current from the device driving transistor with a magnitude suppressed to a value equal to ((N−1)/N) times the magnitude of a driving current which is supplied to a normal pixel circuit not including a defective light emitting sub-device.

It is desirable to provide the active-matrix display apparatus with a signal driver for asserting the video signal on each of the signal lines. The signal driver controls the level of the video signal to be asserted on the signal line and to be latched in the specific pixel circuit including a defective light emitting sub-device already electrically disconnected from the specific pixel circuit so that the (N−1) remaining light emitting sub-devices of the specific pixel circuit receive a driving current from the device driving transistor with a magnitude suppressed to a value equal to ((N−1)/N) times the magnitude of a driving current which is supplied to a normal pixel circuit not including a defective light emitting sub-device.

In order to make the explanation easy to understand, let the magnitude of a driving current flowing through a normal pixel circuit be normalized to 1 (=N/N) where reference notation N denotes a positive integer representing the number of light emitting sub-devices into which every light emitting device is divided. In accordance with an embodiment of the present invention, the (N−1) light emitting sub-devices remaining in a fixed pixel circuit receive a driving current with a magnitude suppressed to a value equal to ((N−1)/N) times the magnitude of a driving current which is supplied to a normal pixel circuit. In other words, the (N−1) light emitting sub-devices remaining in a fixed pixel circuit receive a driving current with a magnitude reduced from the magnitude of 1 for a driving current supplied to a normal pixel circuit by a decrease equal to 1/N. A fixed pixel circuit is a pixel circuit electrically disconnecting a light emitting sub-device having a short-circuit defect from the device driving transistor. Thus, the number of light emitting sub-devices contributing to the light emission in a fixed pixel circuit is smaller by a difference of 1 than the number of light emitting sub-devices contributing to the light emission in a normal pixel circuit. Accordingly, the magnitude of the driving current flowing through a light emitting sub-device in the fixed pixel circuit is equal to the magnitude of the driving current flowing through a light emitting sub-device in the normal pixel circuit. As a result, the speed of the progress of the luminance deterioration in the fixed pixel circuit is equal to the speed of the progress of the luminance deterioration in the normal pixel circuit and, accordingly, no difference in luminance is generated between the fixed pixel circuit and the normal pixel circuit even after the lapse of time. By reducing the magnitude of the driving current flowing through the fixed pixel circuit by a decrease of 1/N at the shipping stage, the luminance deterioration of the fixed pixel circuit can be suppressed to a level equal to that of the normal pixel circuit. Thus, it is not feared that a death-point fault will be generated in the fixed pixel circuit in the future. Since the magnitude of the driving current flowing through the fixed pixel circuit is reduced by a decrease of 1/N at the shipping stage, however, the luminance of light emitted by the fixed pixel circuit is also reduced by a difference corresponding to the decrease of 1/N. Nevertheless, if the reduction of the luminance of light emitted by the fixed pixel circuit is within a tolerance range, the display panel of the active-matrix display apparatus is considered to be good, contributing to the improvement of the yield. If the display panel of the active-matrix display apparatus is considered to be good at the shipping stage, there will be no reliability problem in particular. This is because there is no difference in luminance deterioration between the fixed pixel circuit and the normal pixel circuit even after the lapse of time since the shipping stage.

BRIEF DESCRIPTION OF THE DRAWINGS

These and other innovations as well features of the present invention will become clear from the following description of the preferred embodiments given with reference to the accompanying diagrams, in which.

DETAILED DESCRIPTION OF THE PREFERRED EMBODIMENTS

Figure 1:
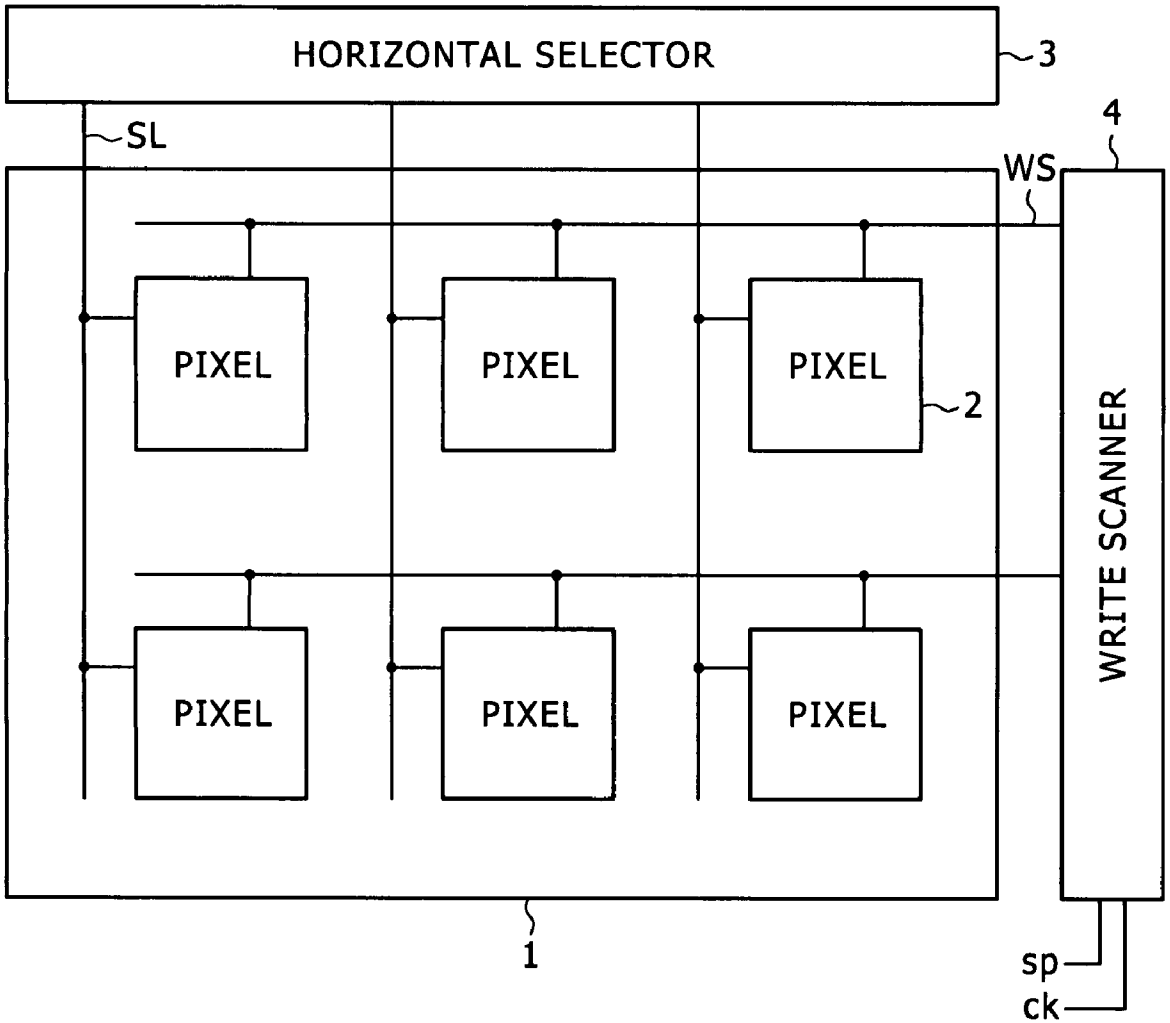
FIG. 1 is a block diagram showing the entire configuration of a first embodiment of the present invention implementing an active-matrix display apparatus.

Preferred embodiments of the present invention are explained in detail by referring to diagrams as follows. FIG. 1 is a block diagram showing the entire configuration of a first embodiment implementing an active-matrix display apparatus provided by an embodiment of the present invention. As shown in the figure, the active-matrix display apparatus employs a pixel array section 1 and driving circuits surrounding the pixel array section 1. The driving circuits are a horizontal selector 3 and a write scanner 4. The pixel array section 1 has a plurality of pixel circuits 2 laid out to form a 2-dimensional matrix. The pixel array section 1 is also provided with signal lines SL each serving as a column of the 2-dimensional matrix and scan lines WS which each serve as a row of the matrix. Each of the pixel circuits 2 is located at an intersection of one of the signal lines SL and one of the scan lines WS.

The write scanner 4 has a shift register. The write scanner 4 operates in accordance with a clock signal ck received from an external source and sequentially transfers a start pulse sp also received from an external source, sequentially asserting a control signal on each of the scan lines WS. The horizontal selector 3 is a section for asserting a video signal on each of the signal lines SL by adjusting the assertion of the video signal to the line sequential scan operation carried out by the write scanner 4.

Figure 2:
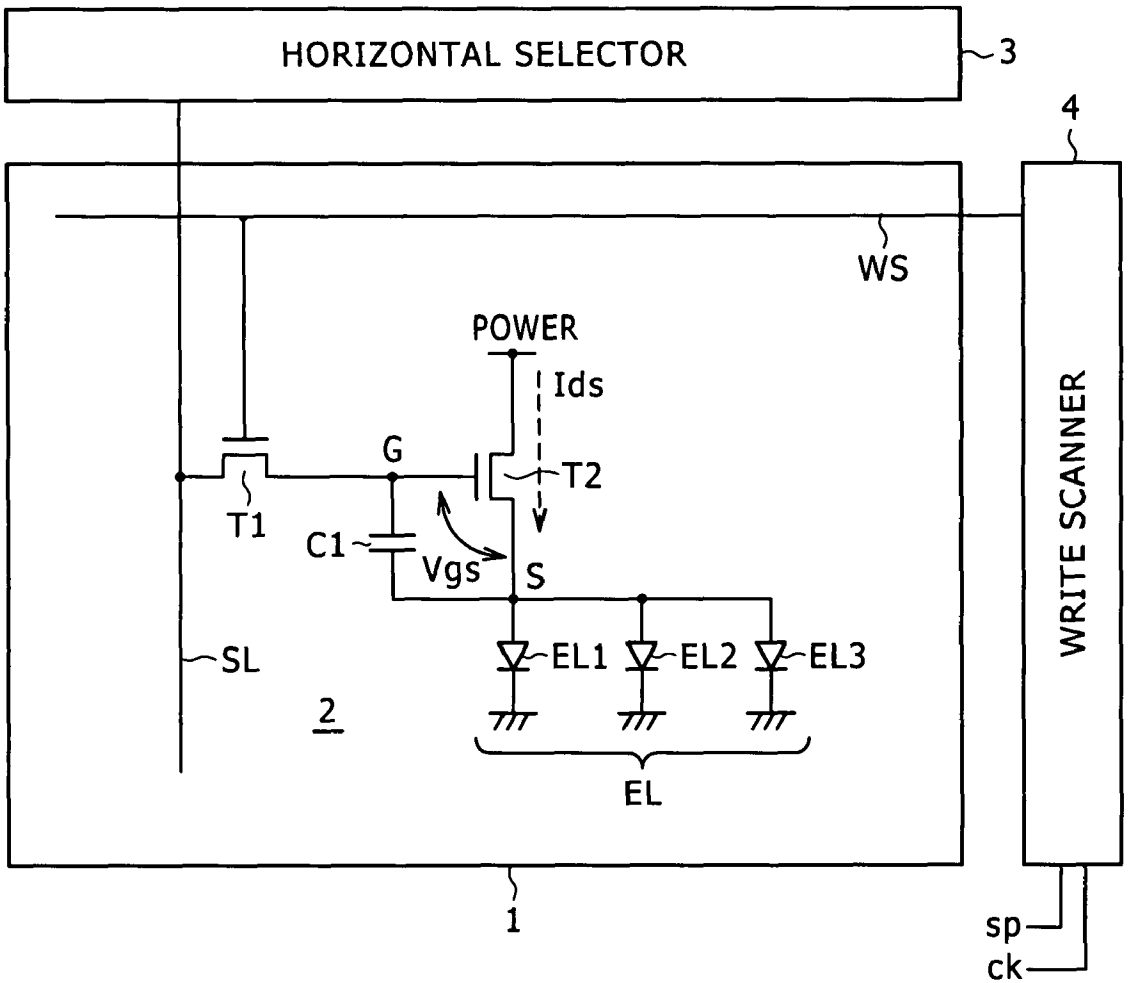
FIG. 2 is a circuit diagram showing the configuration of the active-matrix display apparatus, which is shown in the block diagram of FIG. 1.

FIG. 2 is a circuit diagram showing the configuration of the active-matrix display apparatus, which is shown in the block diagram of FIG. 1, by focusing on a pixel circuit 2. As shown in the circuit diagram of FIG. 2, the pixel circuit 2 employs a signal sampling transistor T1, a device driving transistor T2, a signal holding capacitor C1 and a light emitting device EL. The source electrode of the signal sampling transistor T1 is connected to the signal line SL, the gate electrode of the signal sampling transistor T1 is connected to the scan line WS and the drain electrode of the signal sampling transistor T1 is connected to the gate electrode G of the device driving transistor T2. The drain electrode of the device driving transistor T2 is connected to a power supply whereas the source electrode S of the device driving transistor T2 is connected to the anode of the light emitting device EL. The cathode of the light emitting device EL is connected to the ground. The signal holding capacitor C1 is connected between the gate electrode G of the device driving transistor T2 and the source electrode S of the device driving transistor T2.

In the configuration of the pixel circuit 2 described above, the signal sampling transistor T1 is put in a turned-on state by a control signal asserted on the scan line WS by the write scanner 4. When the signal sampling transistor T1 is put in a turned-on state, the signal sampling transistor T1 latches a video signal asserted on the signal line SL by the horizontal selector 3. The video signal latched by the signal sampling transistor T1 is stored in the signal holding capacitor C1. The device driving transistor T2 is a transistor for generating a driving signal having a magnitude according to the video signal stored in the signal holding capacitor C1. In the first embodiment, the device driving transistor T2 operates in a saturated region to output a drain-source current Ids with a magnitude determined by a gate-source voltage Vgs of the device driving transistor T2 to the light emitting device EL. The light emitting device EL receives the drain-source current Ids as the driving current, emitting light at a magnitude level according to the driving current Ids which is determined by the video signal stored in the signal holding capacitor C1.

The light emitting device EL is a thin-film device having two terminals serving as a pair of electrodes which are referred to as an anode and a cathode. The light emitting device EL also includes a light emitting layer which is sandwiched by the anode and the cathode. At least one of the two electrodes are divided into a plurality of portions so that the light emitting device is virtually divided into a plurality of light emitting sub-devices. In the case of the first embodiment, the anode is divided into three portions so that the light emitting device EL is essentially divided into three light emitting sub-devices EL1, EL2 and EL3. However, the division of the light emitting device EL employed in the pixel circuit 2 provided by an embodiment of the present invention is by no means limited to the division according to the first embodiment. For example, the light emitting device EL can also be divided into four, five or more light emitting sub-devices.

The three light emitting sub-devices EL1, EL2 and EL3 receive a driving current Ids from the device driving transistor T2 and, as a whole, emit light at a luminance level according to the driving current Ids. If any one of the three light emitting sub-devices EL1, EL2 and EL3 is defective, this defective light emitting sub-device is electrically disconnected from the pixel circuit 2. For example, if the light emitting sub-device EL2 is defective, this defective light emitting sub-device EL2 is electrically disconnected from the pixel circuit 2. In this case, the driving current Ids is supplied to the two remaining light emitting sub-devices EL1 and EL3. Thus, the two remaining light emitting sub-devices EL1 and EL3 sustain the emission of light at a luminance level determined by the driving current Ids which is supplied thereto. That is to say, the light emitting device EL emits light at a luminance level according to the driving current Ids supplied thereto without regard to the existence of a light emitting sub-device which is disconnected from the pixel circuit 2. As a result, the fixed pixel circuit 2 is capable of emitting light at a luminance level equal to that of light emitted by a normal pixel circuit 2. A fixed pixel circuit 2 is a pixel circuit 2 obtained by electrically disconnecting a defective light emitting sub-device from the pixel circuit 2. On the other hand, a normal pixel circuit 2 is an original pixel circuit 2 which is capable of normally operating from the beginning.

Figure 3B:
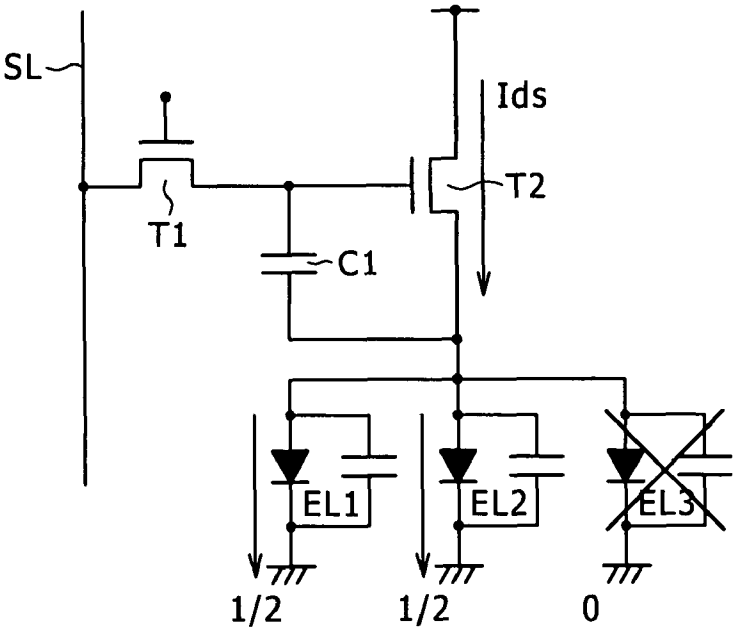
FIGS. 3A and 3B are a plurality of model circuit diagrams each showing an operating state of the pixel circuit shown in the circuit diagram of FIG. 2.
Figure 3A:
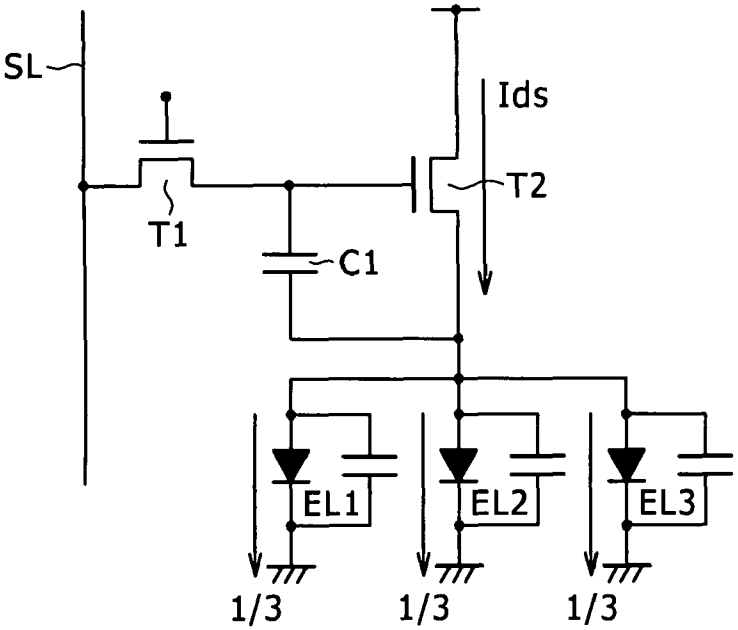

FIGS. 3A and 3B are a plurality of model circuit diagrams each showing an operating state of the pixel circuit 2 shown in the circuit diagram of FIG. 2. To be more specific, FIG. 3A is a model circuit diagram showing the operating state of a normal pixel circuit 2. As shown in the model circuit diagram of FIG. 3A, the device driving transistor T2 supplies a driving current Ids also referred to as a drain-source current cited above to the light emitting device EL in accordance with a video signal, which has been stored in the signal holding capacitor C1 by way of the signal sampling transistor T1. The light emitting device EL includes the three light emitting sub-devices EL1, EL2 and EL3. In the case of a normal pixel circuit 2, a sub-driving-current having a magnitude equal to one-third of the magnitude of the driving current Ids is supplied to each of the three light emitting sub-devices EL1, EL2 and EL3. Thus, as a whole, the driving current Ids is supplied to the light emitting device EL employed in the normal pixel circuit 2. As commonly known, the light emitting device EL emits light at a luminance level according to the driving current Ids supplied to the light emitting device EL.

FIG. 3B is a model circuit diagram showing the operating state of a fixed pixel circuit 2. In the case of the first embodiment, the light emitting device EL becomes short-circuit defective due to a foreign material (or the like) which is stuck on the light emitting sub-device EL3. If the short-circuit defect of the light emitting sub-device EL3 is kept as it is, most of the driving current Ids generated by the device driving transistor T2 will unavoidably flow to the light emitting sub-device EL3 so that the entire pixel circuit 2 can be perceived as a pixel circuit 2 having a death-point fault. In order to solve this problem, the light emitting sub-device EL3 having a short-circuit defect is electrically disconnected from the source electrode of the device driving transistor T2. The state in which the light emitting sub-device EL3 having a short-circuit defect is electrically disconnected from the source electrode of the device driving transistor T2 is shown by an X cross mark drawn over the light emitting sub-device EL3 in the model circuit diagram of FIG. 3B. By electrically disconnecting the light emitting sub-device EL3 having a short-circuit defect from the source electrode of the device driving transistor T2, the driving current Ids supplied by the device driving transistor T2 to the light emitting device EL is split into two portions which flow to the light emitting sub-devices EL1 and EL2 respectively. Each of the two portions flowing to the light emitting sub-devices EL1 and EL2 respectively has a magnitude equal to half the magnitude of the driving current Ids generated by the device driving transistor T2. Thus, since the driving current Ids generated by the device driving transistor T2 also flows to the light emitting device EL even in the case of a fixed pixel circuit 2, the fixed pixel circuit 2 also emits light at a luminance level equal to the level of light emitted by the normal pixel circuit 2 shown in the model circuit diagram of FIG. 3A. As a result, apparently, there is no difference in luminance between light emitted by the normal pixel circuit 2 shown in the model circuit diagram of FIG. 3A and the fixed pixel circuit 2 shown in the model circuit diagram of FIG. 3B.

Figure 4:
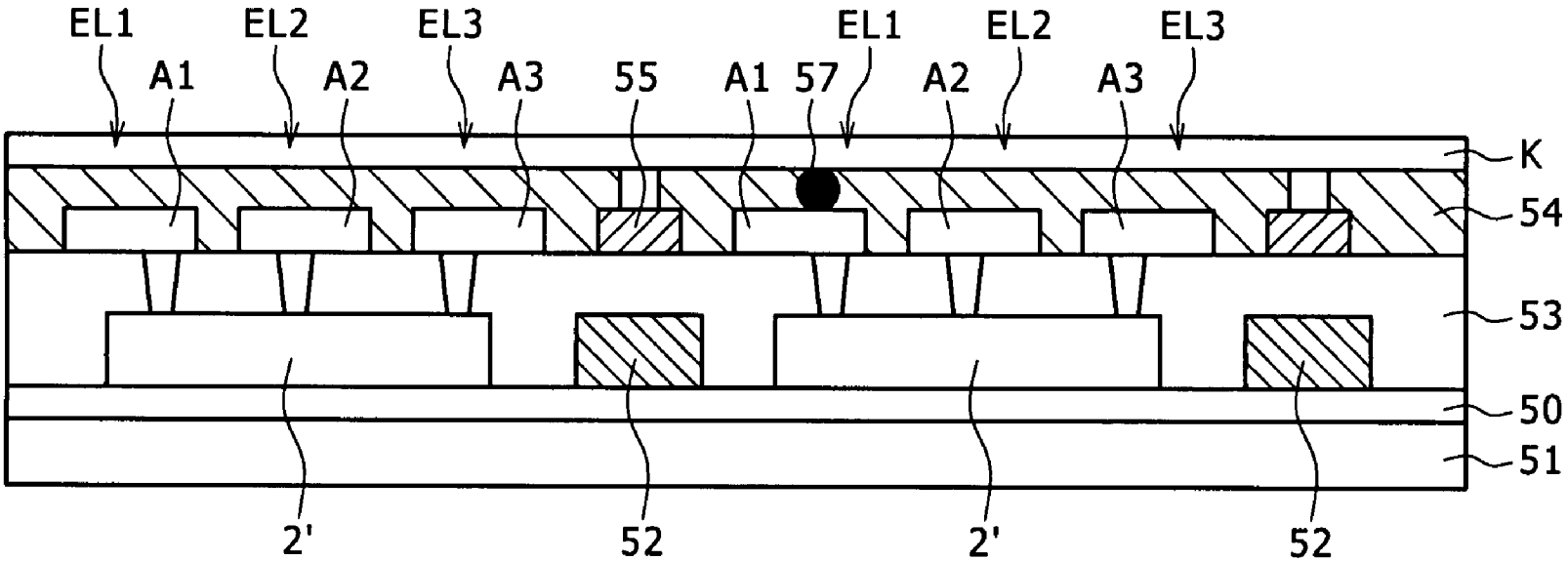
FIG. 4 is a model diagram showing a cross section of a concrete layer configuration of the pixel circuits shown in the circuit diagrams of FIGS. 2 and 3.

FIG. 4 is a model diagram showing a cross section of a concrete layer configuration of the pixel circuits 2 shown in the circuit diagrams of FIGS. 2, 3A and 3B. In order to make the cross-sectional diagram of FIG. 4 simple, the cross-sectional diagram of FIG. 4 shows two pixel circuits 2. As shown in the cross-sectional diagram of FIG. 4, each of the pixel circuits 2 is formed on a substrate 50 made of a material such as the glass material. The rear surface of the substrate 50 is covered by a light shielding layer 51 made of a material such as a metal. A pixel circuit 2 basically has a light emitting device EL and a device driving circuit 2' for driving the light emitting device EL. Formed on the substrate 50, the device driving circuit 2' has thin-film devices which include thin-film transistors and a thin-film capacitor. On the substrate 50, a power-supply wire 52 is also formed. The device driving circuit 2' and the power-supply wire 52 are covered by a flattening layer 53. A light emitting device EL is formed on the flattening layer 53. The light emitting device EL has an anode A, a cathode K and an organic light emitting layer 54 which is sandwiched by the anode A and the cathode K. The anode A is formed for each pixel circuit 2. The anode A is connected to the device driving circuit 2' through a contact hole formed through the flattening layer 53. In addition to the anode A, an auxiliary wire 55 is also formed on the flattening layer 53. The anode A and the auxiliary wire 55 are covered by the organic light emitting layer 54. The cathode K is formed on the organic light emitting layer 54. The cathode K is shared by all pixel circuits 2 as an electrode common to the pixel circuits 2. The cathode K is connected to the auxiliary wire 55 through a contact hole formed through the organic light emitting layer 54. The cathode K is made of a transparent electrode material such as the ITO.

In the embodiment of the present invention, at least one of the two electrodes of the light emitting device EL are divided into a plurality of portions so that the light emitting device EL itself is virtually divided into the same plurality of light-emitting sub-devices. For example, the light emitting device EL is divided into three light-emitting sub-devices EL1, EL2 and EL3. In the typical example shown in the cross-sectional diagram of FIG. 4, the anode A is divided into 3 sub-anodes A1, A2 and A3 whereas the cathode K is shared by all pixel circuits 2 as an electrode common to the pixel circuits 2. It is to be noted that, even though the light emitting device EL is divided into three light-emitting sub-devices EL1, EL2 and EL3 in accordance with the first embodiment, the division of the light-emitting device EL is by no means limited to the division of the first embodiment. For example, the light emitting device EL can be divided into two, four, five or even more light emitting sub-devices. As an example, let a foreign material 57 be stuck on the light emitting sub-device EL1 of the pixel circuit 2 on the right side of the cross-sectional diagram of FIG. 4, giving rise to a short-circuit defect in the light emitting sub-device EL1. In this case, the light emitting sub-device EL1 having the short-circuit defect is electrically disconnected from the device driving circuit 2' in order to supply the driving current Ids to the anodes A2 and A3 of the remaining normal light emitting sub-devices EL2 and EL3 respectively. Thus, it is possible to sustain the state of emitting light at a luminance level according to the driving current Ids which is determined by a video signal.

For example, let the light emitting sub-device EL1 having the short-circuit defect remain electrically connected to the device driving circuit 2' as it is. In this case, the driving current Ids supplied by the device driving circuit 2' to the anode A flows to the cathode K without passing through the organic light emitting layer 54, being concentrated on the conductive foreign material 57. Finally, the driving current Ids flows to the ground through the auxiliary wire 55. Thus, even though the driving current Ids is flowing through the light emitting device EL, the organic light emitting layer 54 barely emits light so that a death-point fault is virtually generated in the pixel circuit 2 including the light emitting device EL. In accordance with an embodiment of the present invention, however, the light emitting sub-device EL1 having the short-circuit defect is electrically disconnected from the device driving circuit 2' in order to prevent a death-point fault from being generated in the pixel circuit 2 including the light emitting device EL. Thus, the manufacturing yield of the display panel of the active-matrix display apparatus is increased.

Figure 5:
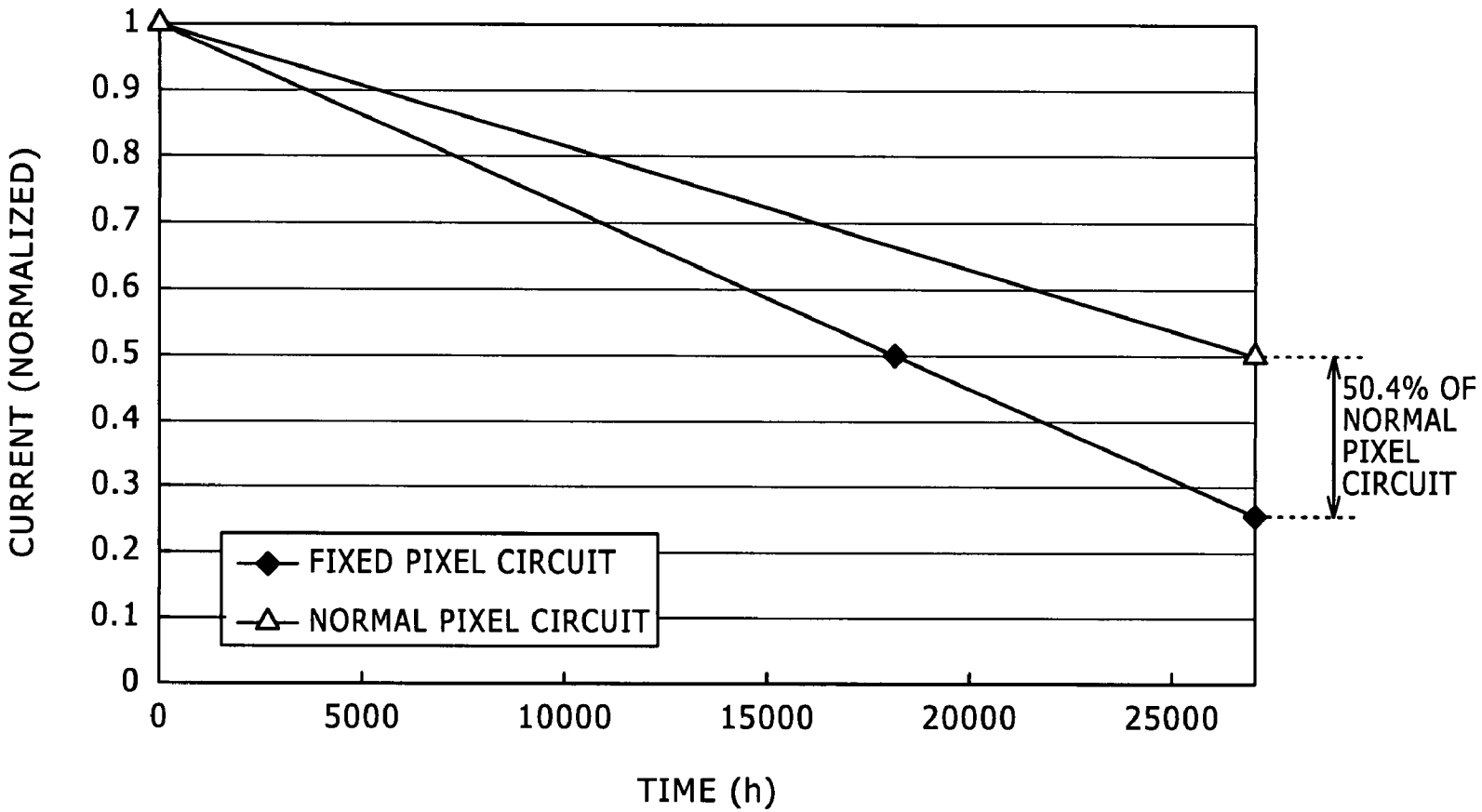
FIG. 5 is a diagram showing graphs each representing the progress of luminance deterioration of a pixel circuit.

FIG. 5 is a diagram showing graphs each representing the progress of the luminance deterioration of a pixel circuit 2. The vertical axis represents the driving current Ids whereas the horizontal axis represents the lapse of time. The driving current Ids represented by the vertical axis is normalized by setting the magnitude of the driving current Ids flowing at an initial time to the light emitting device EL at 1. The luminance of light emitted by the light emitting device EL is proportional to the driving current Ids flowing to the light emitting device EL. In the case of the typical example shown in the diagram of FIG. 5, the light emitting device employed in the pixel circuit 2 is divided into 5 light emitting sub-devices. FIG. 5 shows the progress of the luminance deterioration of a normal pixel circuit 2 and a fixed pixel circuit 2.

The graphs show that the luminance levels of the fixed and normal pixel circuits 2 deteriorate as time goes by. However, there is a difference in progress speed between the luminance deterioration of the normal pixel circuit 2 and the luminance deterioration of the fixed pixel circuit 2. Since the magnitude of the driving current Ids flowing through each light emitting sub-device in the fixed pixel circuit 2 is greater than the magnitude of the driving current Ids flowing through each light emitting sub-device in the normal pixel circuit 2 by a difference in current magnitude, the speed of the progress of the luminance deterioration of the fixed pixel circuit 2 is higher than the speed of the progress of the luminance deterioration of the normal pixel circuit 2 by a progress-speed difference corresponding to the difference in current. At the initial stage, the luminance of light emitted by the fixed pixel circuit 2 is equal to the luminance of light emitted by the normal pixel circuit 2. After the lapse of 25,000 hours, however, there is a luminance difference of about 50% between light emitted by the fixed pixel circuit 2 and light emitted by the normal pixel circuit 2. After the lapsing time has exceeded 25,000 hours, the luminance of light emitted by the fixed pixel circuit 2 is about half the luminance of light emitted by the normal pixel circuit 2, and there is a higher probability that a death-point fault is generated in the fixed pixel circuit 2.

As described above, in accordance with an effect of fixing the pixel circuit 2 including a defective light emitting sub-device, the effect of defect of the defective light emitting sub-device can be eliminated at the initial stage of the generation of a death-point fault. As time goes by, however, the luminance deterioration of the fixed pixel circuit 2 occurs at a suddenly high speed. Finally, the luminance deterioration causes a death-point fault to be generated later.

Figure 6A:
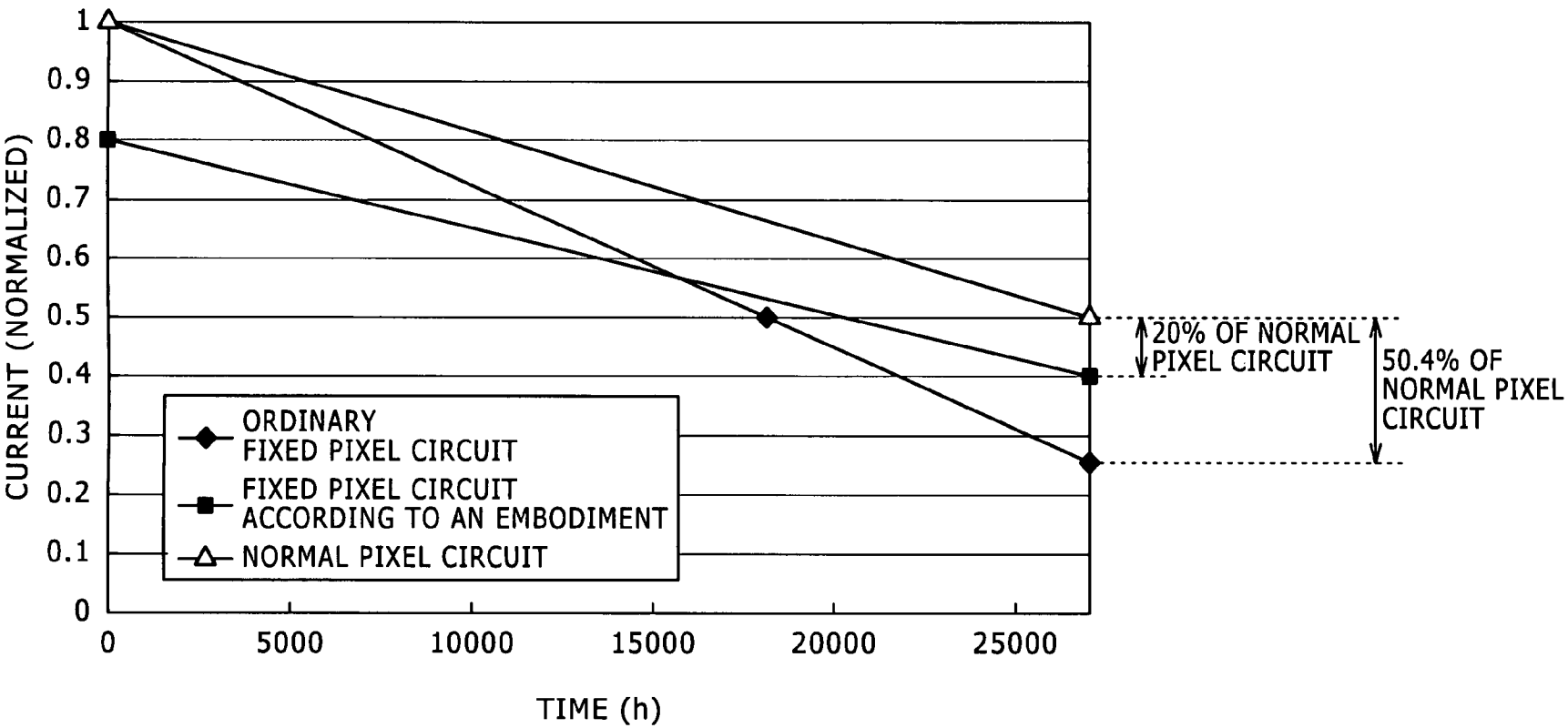
FIG. 6A is a diagram showing three graphs each representing luminance deterioration in the active-matrix display apparatus provided by an embodiment of the present invention.

In order to avoid the death-point fault generated later, in accordance with an embodiment of the present invention, the magnitude of the driving current Ids flowing to the fixed pixel circuit 2 is reduced to a value equal to ((N−1)/N) times the magnitude of the driving current Ids flowing to the normal pixel circuit 2 where reference notation N denotes an integer representing the number of light emitting sub-devices into which a light emitting device is divided. FIG. 6A is a diagram showing three graphs each representing luminance deteriorations in an active-matrix display apparatus provided by an embodiment of the present invention. The vertical axis represents the driving current Ids whereas the horizontal axis represents the lapse of time. The driving current Ids represented by the vertical axis is normalized by setting the magnitude of the driving current Ids flowing at an initial time to the light emitting device EL at 1. The three graphs represent luminance changes in a pixel circuit 2 fixed in accordance with an embodiment of the present invention, a fixed pixel circuit 2 similar to the fixed pixel circuit 2 shown in the diagram of FIG. 5 and the normal pixel circuit 2 respectively. The three graphs allow luminance deteriorations of the pixel circuit 2 fixed in accordance with an embodiment of the present invention, the fixed pixel circuit 2 similar to the fixed pixel circuit 2 shown in the diagram of FIG. 5 and the normal pixel circuit 2 to be compared with each other. In the following description, the pixel circuit 2 fixed in accordance with an embodiment of the present invention is referred to as a fixed pixel circuit 2 according to the first embodiment whereas the fixed pixel circuit 2 similar to the fixed pixel circuit 2 shown in the diagram of FIG. 5 is referred to as an ordinary fixed pixel circuit 2.

As is obvious from the graphs, the initial value of the luminance of light emitted by the fixed pixel circuit 2 according to the first embodiment is 20% smaller than the initial value of the luminance of light emitted by the ordinary fixed pixel circuit 2 and the initial value of the luminance of light emitted by the normal pixel circuit 2. This is because, in accordance with an embodiment of the present invention, the magnitude of the driving current Ids flowing to the fixed pixel circuit 2 according to the first embodiment is reduced to a value equal to ((N−1)/N)=((5−1)/5)=0.8 times the magnitude of the driving current Ids flowing to the normal pixel circuit 2 or the magnitude of the driving current Ids flowing to the ordinary fixed pixel circuit 2. That is to say, in the case of the fixed pixel circuits 2 represented by the graphs shown in the diagram of FIG. 6A, the integer N representing the number of light emitting sub-devices into which a light emitting device is divided is set at 5. Thus, at the initial time, the initial value of the luminance of light emitted by the fixed pixel circuit 2 according to the first embodiment is 20% smaller than the initial value of the luminance of light emitted by the normal pixel circuit 2 or the initial value of the luminance of light emitted by the ordinary fixed pixel circuit 2. However, such a luminance difference of about 20% is almost not recognized visually so that, essentially, no dead-point fault is generated.

As time goes by thereafter, the luminance deterioration of each of the fixed pixel circuit 2 according to the first embodiment, the ordinary fixed pixel circuit 2 and the normal pixel circuit 2 progresses so that the luminance of light emitted by each of the pixel circuits 2 decreases. Since the magnitude of the driving current Ids flowing through every light emitting sub-device in the ordinary fixed pixel circuit 2 is larger than the magnitude of the driving current Ids flowing through every light emitting sub-device in the normal fixed pixel circuit 2, the speed of the progress of the luminance deterioration in the ordinary fixed pixel circuit 2 is higher than the speed of the progress of the luminance deterioration in the normal pixel circuit 2. Thus, after the lapsing time has exceeded 25,000 hours, the luminance of light emitted by the ordinary fixed pixel circuit 2 is decreased to a value smaller than about half the luminance of light emitted by the normal pixel circuit 2, and it is quite within the bounds of possibility that a death-point fault is generated in the ordinary fixed pixel circuit 2.

Since the magnitude of the driving current Ids flowing through every light emitting sub-device in the fixed pixel circuit 2 according to the first embodiment is equal to the magnitude of the driving current Ids flowing through every light emitting sub-device in the ordinary fixed pixel circuit 2, on the other hand, the speed of the progress of the luminance deterioration in the fixed pixel circuit 2 according to the first embodiment is equal to the speed of the progress of the luminance deterioration in the normal pixel circuit 2. Thus, even after the lapsing time has exceeded 25,000 hours, the difference between the luminance of light emitted by the fixed pixel circuit 2 according to the first embodiment and the luminance of light emitted by the normal pixel circuit 2 remains at 20%, and no death-point fault is generated in the fixed pixel circuit 2 according to the first embodiment.

Figure 6B:
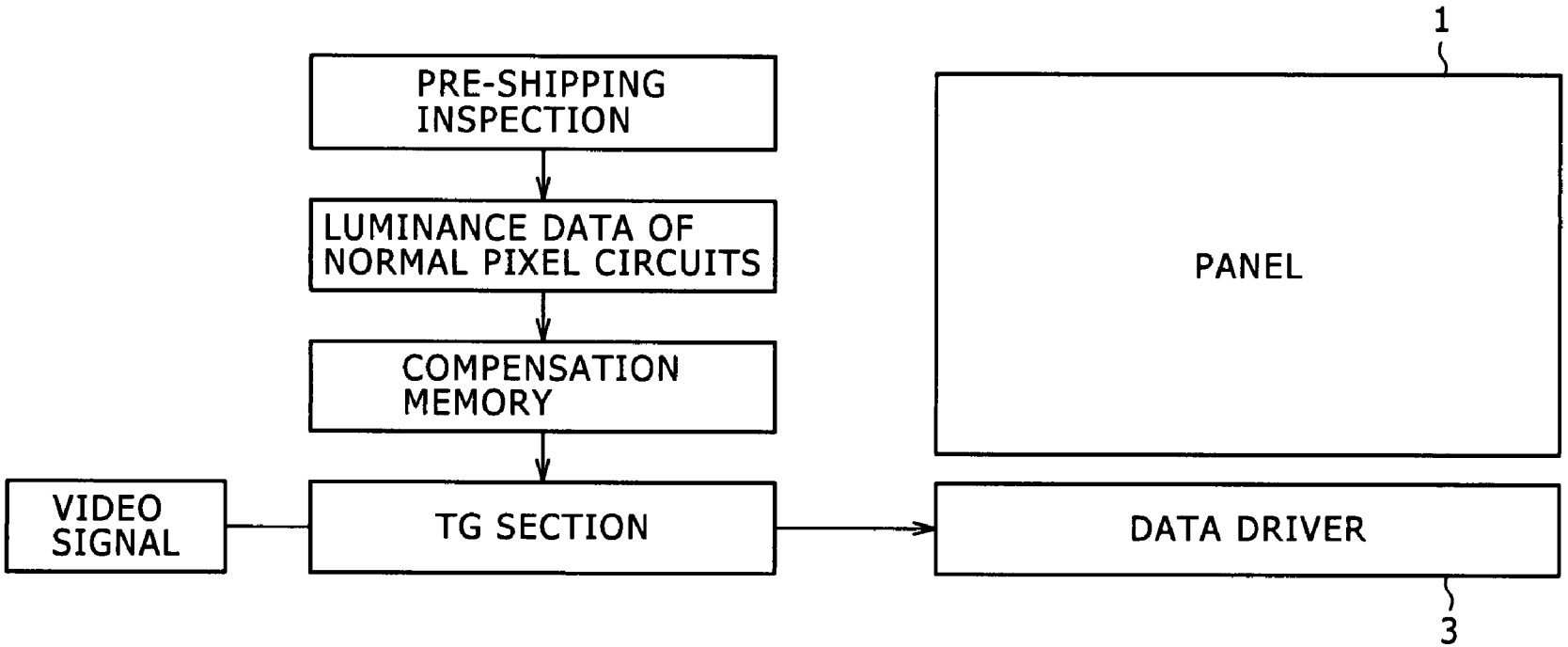
FIG. 6B is a model block diagram to be referred to in description of a control method for adjusting the level of a video signal to be supplied to pixel circuits.

As described above, in accordance with an embodiment of the present invention, the magnitude of the driving current Ids flowing to the fixed pixel circuit 2 according to the first embodiment is controlled to a value equal to ((N−1)/N) times the magnitude of the driving current Ids flowing to the normal pixel circuit 2. The control is executed by typically adjusting the level of a video signal supplied originally from an external source to the pixel array section 1 (or the display panel). In other words, the level of the video signal to be stored in the fixed pixel circuit 2 according to the first embodiment is adjusted so that the magnitude of the driving current Ids flowing to the fixed pixel circuit 2 is reduced to a value equal to ((N−1)/N) times the magnitude of the driving current Ids flowing to the normal pixel circuit 2. FIG. 6B is a model block diagram referred to in description of the control method for adjusting the level of the video signal. As shown in the figure, the level of the video signal supplied originally from the external source is converted by a level shifter employed in a TG (Time Generator) section. After the level conversion process, the video signal is supplied to the horizontal selector 3 (data driver) employed in the active-matrix display apparatus. The video signal supplied to the horizontal selector 3 (data driver) after completion of the level conversion process is supplied to the pixel array section 1 (or the display panel).

An inspection prior to shipping is carried out in order to detect a dead point and fix a defective pixel circuit 2. The location of every fixed pixel circuit 2 on the pixel array section 1 (or the display panel) is stored in a compensation memory. In addition, luminance data of normal pixel circuits 2 is also measured and stored in the compensation memory in advance.

The level shifter employed in the TG (Time Generator) section shifts only the level of a video signal to be stored in each of the fixed pixel circuits 2 and supplies the video signal to the horizontal selector 3. In the level conversion process, the level shifter adjusts the level of the video signal so that the luminance of light emitted by the fixed pixel circuit 2 is reduced to a value equal to ((N−1)/N) times the luminance of light emitted by the normal pixel circuit 2. As a result, the video signal sequentially asserted by the horizontal selector 3 serving as a data driver on the signal line SL in accordance with a line-after-line scan operation is capable of sustaining a difference in driving current Ids between the fixed pixel circuit 2 and the normal pixel circuit 2 at 1/N so that no dead-point fault is generated later on.

Figure 7:
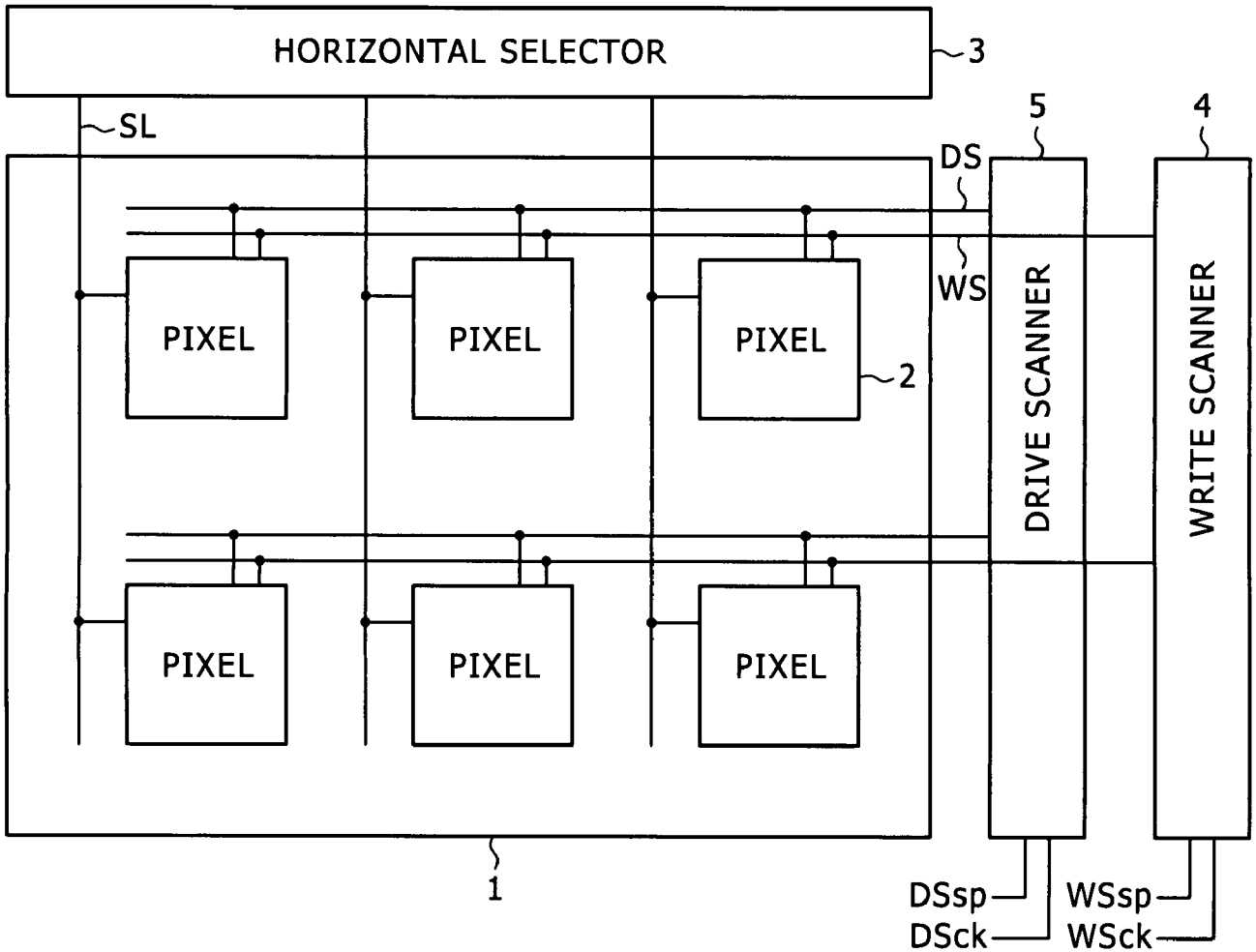
FIG. 7 is a block diagram showing the entire configuration of a second embodiment of the present invention, implementing an active-matrix display apparatus.

FIG. 7 is a block diagram showing the entire configuration of a active-matrix display apparatus according to a second embodiment of the present invention. As shown in the figure, the active-matrix display apparatus employs a pixel array section 1 and driving sections for driving the pixel array section 1. In the case of the second embodiment, the driving sections are a horizontal selector 3, a write scanner 4 and a drive scanner 5. The pixel array section 1 has a plurality of pixel circuits 2 laid out to form a 2-dimensional matrix. The pixel array section 1 is also provided with signal lines SL each serving as a column of the 2-dimensional matrix and scan lines WS which each serve as a row of the matrix. In addition, the pixel array section 1 also has power-supply lines DS which each serve as a row of the 2-dimensional matrix. As a matter of fact, a pair including a scan line WS and a power-supply line DS forms a row of the 2-dimensional matrix. Each of the pixel circuits 2 is located at an intersection of one of the signal lines SL and one of the scan lines WS or one of the power-supply lines DS.

The write scanner 4 is a control scanner for sequentially scanning the pixel circuits 2 on a line-after-line basis or a row-after-row basis and sequentially asserting a control signal pulse on the scan lines WS. The drive scanner 5 is a power-supply scanner for asserting a power-supply voltage at a first electric potential Vcc and a power-supply voltage at a second electric potential Vss on the power-supply lines DS with timings adjusted to the line-after-line scan operations carried out by the write scanner 4. The horizontal selector 3 is a signal selector for asserting a video-signal electric potential Vsig serving as a video signal and a reference electric potential Vofs on the signal lines SL each stretched as a column of the matrix with timings adjusted to the line-after-line scan operations carried out by the write scanner 4.

It is to be noted that the write scanner 4 operates in accordance with a clock signal WSck received from an external source and sequentially transfers a start pulse WSsp also received from an external source, sequentially asserting a control signal pulse on each of the scan lines WS. By the same token, the drive scanner 5 operates in accordance with a clock signal DSck received from an external source and sequentially transfers a start pulse DSsp also received from an external source, sequentially asserting the power-supply voltages at different electric potentials Vcc and Vss on each of the power-supply lines DS.

Figure 8:
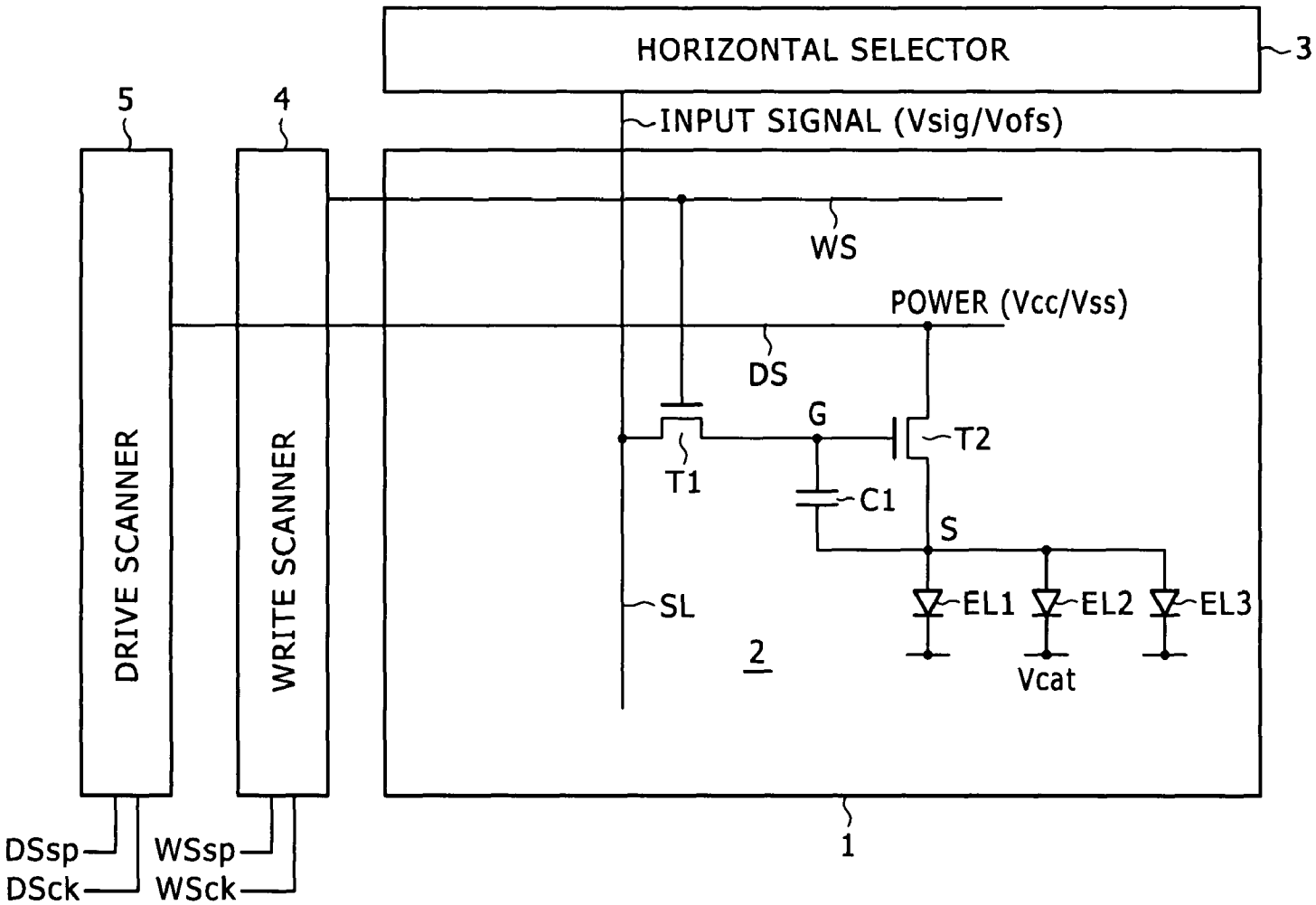
FIG. 8 is a circuit diagram showing the configuration of the active-matrix display apparatus, which is shown in the block diagram of FIG. 7.

FIG. 8 is a circuit diagram showing the configuration of the active-matrix display apparatus, which is shown in the block diagram of FIG. 7, by focusing on the concrete circuit of a pixel circuit 2. As shown in the circuit diagram of FIG. 8, the horizontal selector 3 functioning as a signal selector asserts a video-signal electric potential Vsig serving as a video signal and a reference electric potential Vofs on the signal lines SL each stretched as a column of the matrix with timings adjusted to the line-after-line scan operations carried out by the write scanner 4. The line-after-line scan operations are carried out by the write scanner 4 by sequentially asserting control signal pulses on the scan lines WS in a horizontal period. The horizontal selector 3 functioning as a signal selector asserts a video-signal electric potential Vsig serving as a video signal and a reference electric potential Vofs on the signal lines SL each stretched as a column of the matrix with timings adjusted to the line-after-line scan operations carried out by the write scanner 4 by switching the video-signal electric potential Vsig to the reference electric potential Vofs or vice versa in 1 horizontal period which is referred to as 1H.

In the concrete configuration of the pixel circuit 2 shown in the circuit diagram of FIG. 8, the signal sampling transistor T1 is in a turned-on state during a period between the rising and falling edges of a control pulse asserted by the write scanner 4 serving as a control scanner on the scan line WS. If the horizontal selector 3 asserts a video-signal electric potential Vsig representing a video signal on the signal line SL with the signal sampling transistor T1 already put in the turned-on state, the signal sampling transistor T1 samples the video-signal electric potential Vsig from the signal line SL and stores the sampled-video-signal electric potential Vsig in the signal holding capacitor C1. At the same time, the driving current Ids flowing through the device driving transistor T2 with the sampled video-signal electric potential Vsig stored in the signal holding capacitor C1 is fed back to the signal holding capacitor C1 in a negative feedback operation. That is to say, a compensation voltage for the mobility μ of the device driving transistor T2 is subtracted from the signal electric potential stored in the signal holding capacitor C1.

The pixel circuit 2 shown in the circuit diagram of FIG. 8 also has a threshold-voltage compensation function in addition to the mobility compensation function described above. The threshold-voltage compensation function is described in detail as follows. With a first timing, the drive scanner 5 serving as a power-supply scanner changes the power-supply voltage appearing on the power-supply line DS from the first electric potential Vcc to the second electric potential Vss prior to the video-signal write process carried out to sample the video-signal electric potential Vsig from the signal line SL. Subsequently, with a second timing, the write scanner 4 serving as a control scanner puts the signal sampling transistor T1 in a turned-on state in order to sample the reference electric potential Vofs from the signal line SL and apply the sampled reference electric potential Vofs to the gate electrode G of the device driving transistor T2 also prior to the video-signal write process. The source electric potential Vs appearing at the source electrode S of the device driving transistor T2 is also lowered to the second electric potential Vss so that the pixel circuit 2 makes a transition from a light emission period to a no-light emission period. Then, with a third timing, the drive scanner 5 changes the power-supply voltage appearing on the power-supply line DS from the second electric potential Vss back to the first electric potential Vcc. The gate-source voltage Vgs representing the difference between the gate electric potential Vg appearing at the gate electrode G of the device driving transistor T2 and the source electric potential Vs appearing at the source electrode S of the device driving transistor T2 is the voltage stored in the signal holding capacitor C1. By carrying out the threshold-voltage compensation function, it is possible to get rid of effects of variations exhibited by the threshold voltage Vth of the device driving transistor T2 from pixel circuit to pixel circuit on the display screen of the active-matrix display apparatus. It is to be noted that the first timing may follow the second timing, and vice versa.

The pixel circuit 2 shown in the circuit diagram of FIG. 8 is also provided with a bootstrap function. The bootstrap function is explained in detail as follows. At the end of the video-signal write process and the mobility compensation process, with the video-signal electric potential Vsig applied to the gate electrode G of the device driving transistor T2 and stored in the signal holding capacitor C1, the write scanner 4 puts the signal sampling transistor T1 in a turned-off state in order to electrically disconnect the gate electrode G of the device driving transistor T2 from the signal line SL. The gate electric potential Vg appearing at the gate electrode G of the device driving transistor T2 increases in a manner interlocked with the rising behavior of the source electric potential Vs appearing at the source electrode S of the device driving transistor T2. As a result, the gate-source voltage Vgs representing the difference between the gate electric potential Vg appearing at the gate electrode G of the device driving transistor T2 and the source electric potential Vs appearing at the source electrode S of the device driving transistor T2 is sustained at a constant value. Therefore, the gate-source voltage Vgs of the device driving transistor T2 can be sustained at a constant value even if the current-voltage characteristic of the light emitting device EL changes with the lapse of time.

In the embodiment of the present invention, the light emitting device EL is a thin-film device having two terminals serving as a pair of electrodes which are referred to as an anode and a cathode. At least one of the two electrodes are divided into a plurality of portions so that the light emitting device is virtually divided into the same plurality of light emitting sub-devices. In the case of the first embodiment, the anode is divided into three portions so that the light emitting device EL is essentially divided into three light emitting sub-devices EL1, EL2 and EL3.

The N light emitting sub-devices receive a driving current Ids from the device driving transistor T2 and, as a whole, emit light at a luminance level according to the driving current Ids which is determined by the video signal latched by the signal sampling transistor T1 in the signal holding capacitor C1. If any one of the N light emitting sub-devices is defective, this defective light emitting sub-device is electrically disconnected from the pixel circuit 2 and the driving current Ids is supplied to the (N−1) remaining light emitting sub-devices so that the (N−1) remaining light emitting sub-devices receive a driving current Ids with a magnitude suppressed to a value equal to ((N−1)/N) times the magnitude of a driving current Ids which is supplied to a normal pixel circuit 2.

Figure 9:
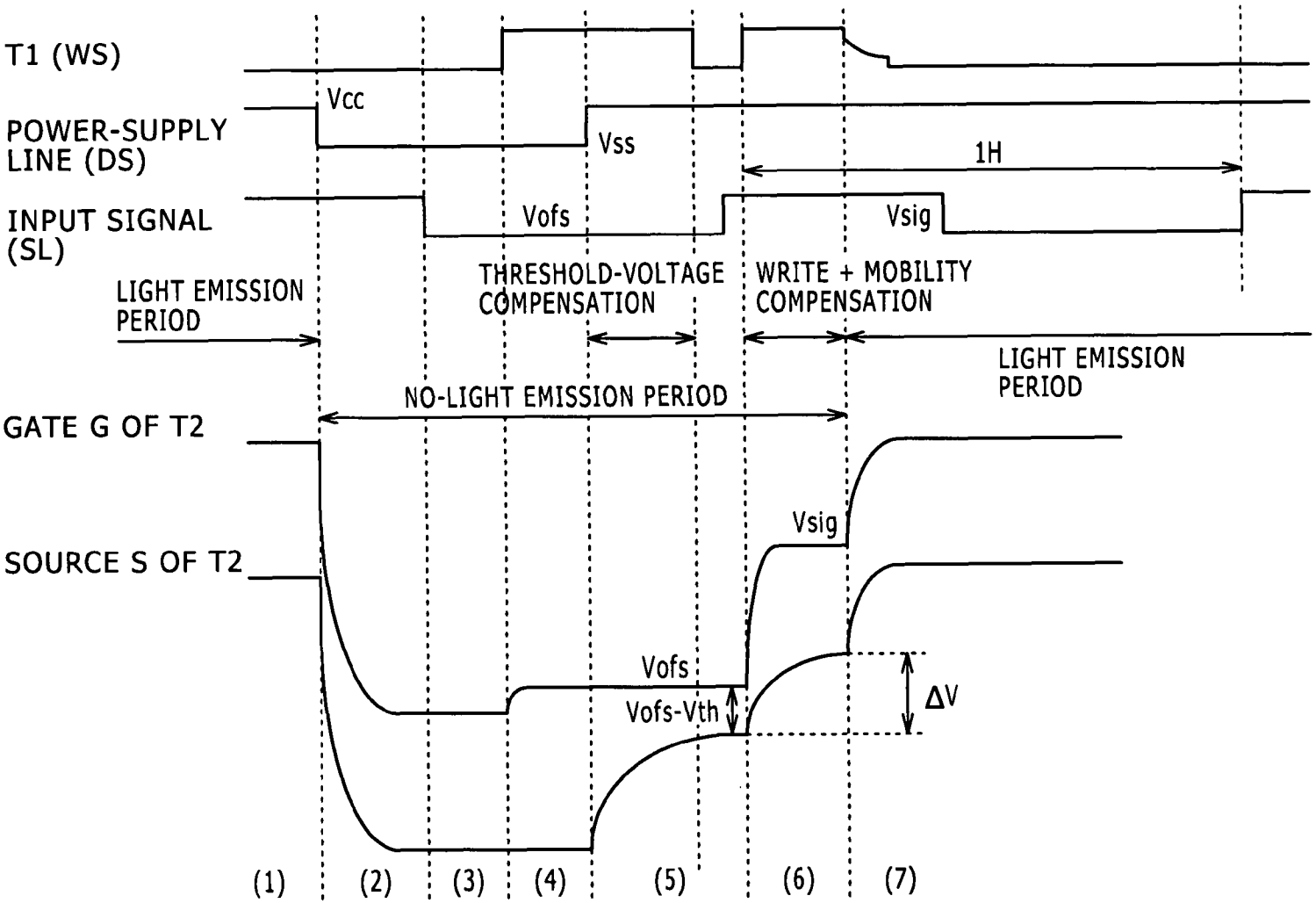
FIG. 9 is an explanatory timing diagram to be referred to in description of operations carried out by the pixel circuit shown in the circuit diagram of FIG. 8.
Figure 10:
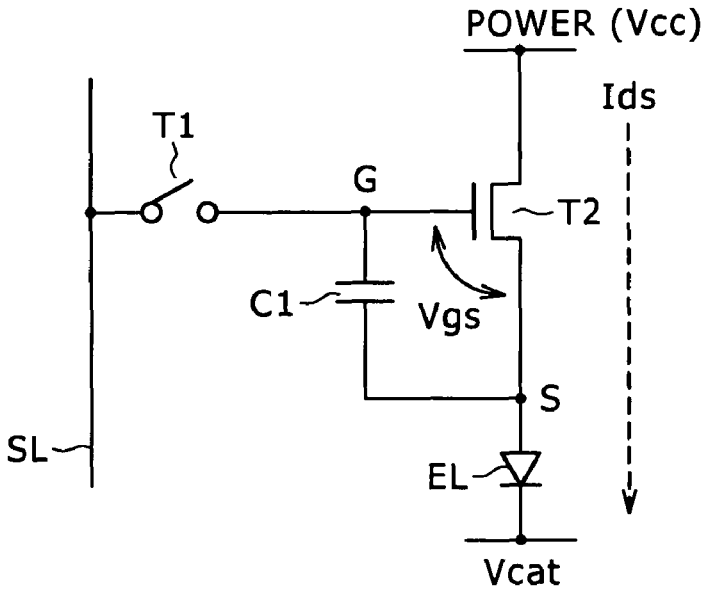
FIG. 10 is an explanatory circuit diagram to be referred to in description of operations carried out by the pixel circuit shown in the circuit diagram of FIG. 8 in period (1) shown in the explanatory timing diagram of FIG. 9.

FIG. 9 is an explanatory timing diagram referred to in description of operations carried out by the pixel circuit 2 shown in the circuit diagram of FIG. 8. The timing diagram shows timing charts representing changes of electric potentials appearing on the scan line WS, the power-supply line DS, the signal line SL, the gate electrode G of the device driving transistor T2 and the source electrode S of the device driving transistor T2 by making use of the horizontal time axis as a common axis. The electric potential appearing on the scan line WS is the electric potential of a control signal applied to the gate electrode of the signal sampling transistor T1 as a signal for putting the signal sampling transistor T1 in a turned-on state or a turned-off state. The electric potential appearing on the power-supply line DS is either of the first electric potential Vcc and the second electric potential Vss. The electric potential appearing on the signal line SL is the electric potential of an input signal supplied to the source electrode of the signal sampling transistor T1 to serve as the video-signal electric potential Vsig or the reference electric potential Vofs. The changes of electric potentials appearing at the gate electrode G of the device driving transistor T2 and the source electrode S of the device driving transistor T2 are a result of the changes of electric potentials appearing on the scan line WS, the power-supply line DS and the signal line SL. The difference in electric potential between the gate electrode G of the device driving transistor T2 and the source electrode S of the device driving transistor T2 is referred to as the gate-source voltage Vgs described earlier.

The lapsing time represented by the horizontal axis of the timing diagram of FIG. 8 is properly segmented into periods (1) to (7) during each of which an operation of the pixel circuit 2 is carried out. In period (1) immediately prior to the start of a field, the light emitting device EL is in a light emission state. Right after period (1), a new field of the line-after-line sequential scan operation is started. That is to say, first of all, a transition from period (1) to period (2) is made when the power-supply signal asserted on the power-supply line DS is lowered from the first electric potential Vcc to the second electric potential Vss. The transition from period (1) to period (2) is also a transition made by the light emitting device EL to change the operating state of the light emitting device EL from a light emission state to a no-light emission state.

Then, a transition from period (2) to period (3) is made when the input signal asserted on the signal line SL is lowered from the video-signal electric potential Vsig to the reference electric potential Vofs. Subsequently, a transition from period (3) to period (4) is made when the control signal asserted on the scan line WS is raised from an L (low) level to an H (high) level in order to put the signal sampling transistor T1 in a turned-on state. During periods (2) to (4). The gate voltage of the drive transistor T2 and the source voltage at light emission period are initialized. Periods (2) to (4) is a period during which a threshold-voltage compensation preparation process is carried out in order to make a preparation for a threshold-voltage compensation process to be carried out in period (5). That is to say, the threshold-voltage compensation preparation process is carried out to in order to initialize the gate electric potential Vg appearing at the gate electrode G of the device driving transistor T2 at the reference electric potential Vofs and the source electric potential Vs appearing at the source electrode S of the device driving transistor T2 at the second electric potential Vss. In period (5), the actual threshold-voltage compensation is carried out. That is why period (5) is also referred to as a threshold-voltage compensation period. After the gate-source voltage Vgs representing the difference between the gate electric potential Vg appearing at the gate electrode G of the device driving transistor T2 and the source electric potential Vs appearing at the source electrode S of the device driving transistor T2 has become equal to a voltage corresponding to the threshold voltage Vth of the device driving transistor T2, the control signal asserted on the scan line WS is lowered from the H level back to the L level in order to put the signal sampling transistor T1 in a turned-off state at the end of the threshold-voltage compensation period. That is to say, the control signal asserted on the scan line WS is lowered from the H level back to the L level in order to put the signal sampling transistor T1 in a turned-off state so as to terminate period (5). At the end of the threshold-voltage compensation period, the voltage corresponding to the threshold voltage Vth of the device driving transistor T2 is actually stored in the signal holding capacitor C1 which is connected between the gate electrode G of the device driving transistor T2 and the source electrode S of the device driving transistor T2.

In period (6), the video-signal electric potential Vsig appearing on the signal line SL to represent the video signal is added to the voltage already stored in the signal holding capacitor C1 as a voltage corresponding to the threshold voltage Vth of the device driving transistor T2. The mobility compensation voltage ΔV is subtracted from the voltage already stored in the signal holding capacitor C1 as a voltage corresponding to the threshold voltage Vth of the device driving transistor T2. Prior to the start of the joint period of the signal write process and the mobility compensation process, the input signal asserted on the signal line SL must be raised from the reference electric potential Vofs back to the video-signal electric potential Vsig of the video signal and, then, the joint period is started when the control signal asserted on the scan line WS is raised again from the L (low) level to the H (high) level in order to put the signal sampling transistor T1 in a turned-on state.

In the light emission period, the light emitting device EL is emitting light at a luminance level according to a voltage stored in the signal holding capacitor C1. As is obvious from the above description, the voltage stored in the signal holding capacitor C1 is a value obtained as a result of the processes to adjust the video-signal electric potential Vsig by making use of the threshold voltage Vth of the device driving transistor T2 and making use of the mobility compensation voltage ΔV dependent on the mobility μ of the device driving transistor T2. That is to say, the luminance of light emitted by the light emitting device EL is neither affected by variations of the threshold voltage Vth of the device driving transistor T2 nor affected by variations of the mobility μ of the device driving transistor T2.

It is to be noted that, period (7) including a light emission period is started when the signal sampling transistor T1 is put in a turned-off state in order to electrically disconnect the gate electrode G of the device driving transistor T2 from the signal line SL so as to put the gate electrode G in a floating state and, thus, allow a bootstrap operation to occur prior. At the beginning of period (7) including the light emission period, the source electric potential Vs appearing at the source electrode S of the device driving transistor T2 is rising. While the source electric potential Vs appearing at the source electrode S of the device driving transistor T2 is rising, the gate electric potential Vg is also rising in a manner interlocked with the rising behavior of the source electric potential Vs in the bootstrap operation. In the bootstrap operation, the gate-source voltage Vgs which is the difference in electric potential between the gate electrode G of the device driving transistor T2 and the source electrode S of the device driving transistor T2 is thus sustained at a constant value by letting the gate electric potential Vg appearing at the gate electrode G of the device driving transistor T2 increase in a manner interlocked with the rising behavior of the source electric potential Vs appearing at the source electrode S of the device driving transistor T2.

Next, operations carried out by the pixel circuit 2 shown in FIG. 8 are explained in detail by referring to diagrams of FIGS. 10 to 17 as follows. First of all, in period (1) serving as a light emission period, the first electric potential Vcc is appearing on the power-supply line DS and the signal sampling transistor T1 has been put in a turned-off state as shown in a circuit diagram of FIG. 10. In this period, the device driving transistor T2 is set to operate in a saturated region. Thus, the driving current Ids flowing to the light emitting device EL has a magnitude which is determined by the gate-source voltage Vgs of the device driving transistor T2 in accordance with a transistor characteristic equation given earlier.

Figure 11:
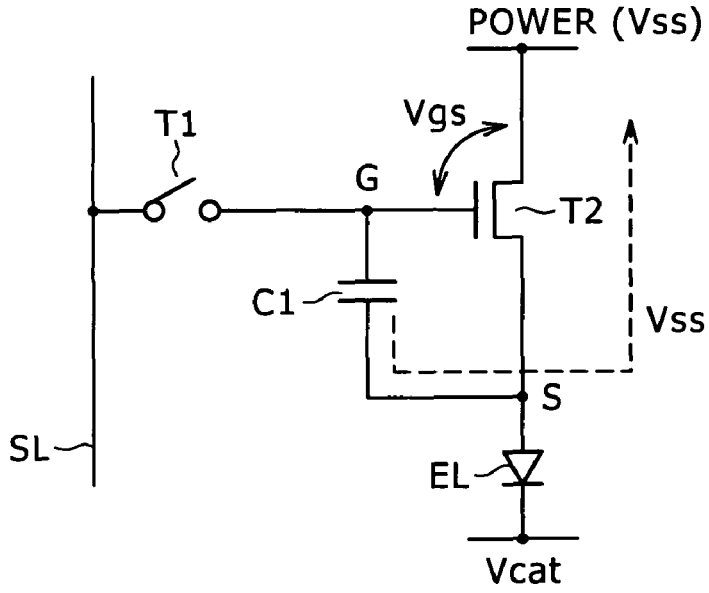
FIG. 11 is an explanatory circuit diagram to be referred to in description of operations carried out by the pixel circuit shown in the circuit diagram of FIG. 8 in periods (2) and (3) shown in the explanatory timing diagram of FIG. 9.

Then, when the power-supply line appearing on the power-supply line DS is lowered from the first electric potential Vcc to the second electric potential Vss as shown in a circuit diagram of FIG. 11, a transition is made from period (1) to period (2) to be followed by period (3). The second electric potential Vss is set at a level lower than the sum of a cathode electric potential Vcat appearing at the cathode of the light emitting device EL and the threshold voltage Vthel of the light emitting device EL. That is to say, the following relation is satisfied: Vss<(Vthel+Vcat). Thus, the light emitting device EL is in a turned-off state. A specific one of the two main electrodes of the device driving transistor T2 is connected to the power-supply line DS. In this state, the specific main electrode of the device driving transistor T2 is functioning as the source electrode of the device driving transistor T2. At this time, the anode of the light emitting element EL is charged to Vss.

Figure 12:
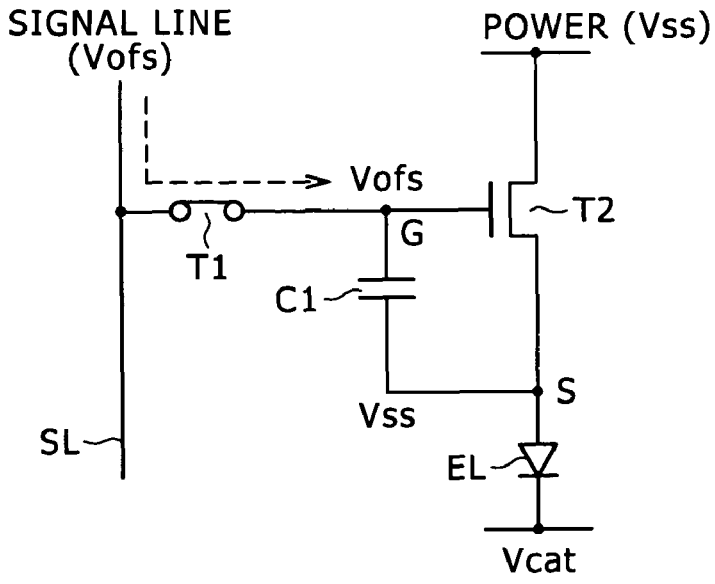
FIG. 12 is an explanatory circuit diagram to be referred to in description of operations carried out by the pixel circuit shown in the circuit diagram of FIG. 8 in period (4) shown in the explanatory timing diagram of FIG. 9.
Figure 13:
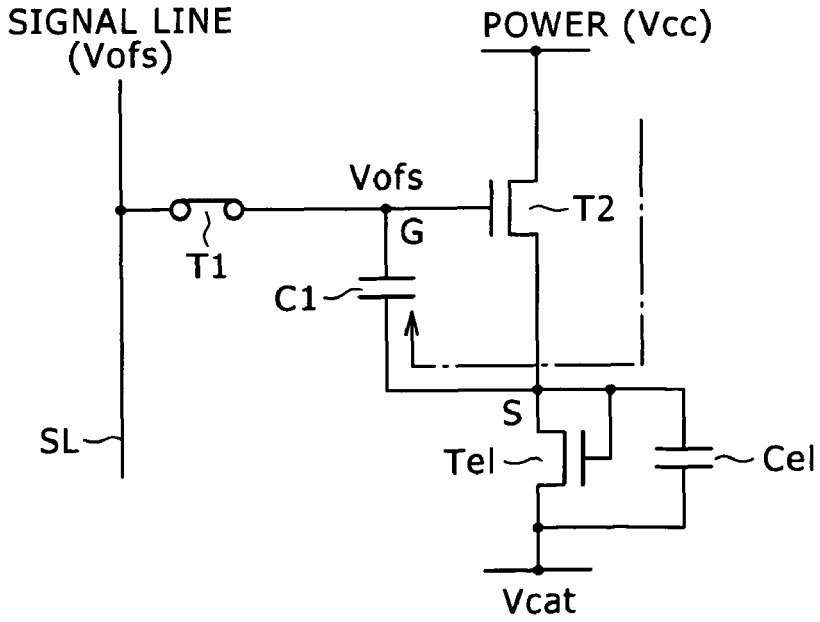
FIG. 13 is an explanatory circuit diagram to be referred to in description of operations carried out by the pixel circuit shown in the circuit diagram of FIG. 8 in period (5) shown in the explanatory timing diagram of FIG. 9.

Then, a transition from period (3) to period (4) is made when the control signal asserted on the scan line WS is raised from an L (low) level to an H (high) level in order to put the signal sampling transistor T1 in a turned-on state as shown in a circuit diagram of FIG. 12. With the signal sampling transistor T1 put in a turned-on state, the reference electric potential Vofs set on the transition from period (2) to period (3) is applied to the gate electrode G of the device driving transistor T2. In this no-light emission period, the gate electric potential Vg appearing at the gate electrode G of the device driving transistor T2 is initialized at the reference electric potential Vofs whereas the source electric potential Vs appearing at the source electrode S of the device driving transistor T2 is initialized at the second electric potential Vss. Thus, the gate-source voltage Vgs representing the difference between the gate electric potential Vg appearing at the gate electrode G of the device driving transistor T2 and the source electric potential Vs appearing at the source electrode S of the device driving transistor T2 is initialized at (Vofs−Vss), that is, the following equation is satisfied: Vgs=Vofs−Vss. The reference electric potential Vofs and the second electric potential Vss are set at such values that the gate-source voltage Vgs of the device driving transistor T2 is initialized at a value greater than the threshold voltage Vth of the device driving transistor T2, that is, the following relation is satisfied: Vgs>Vth. This initialization process is also referred to as a threshold-voltage compensation preparation process which is completed at the end of period (4).

Then, period (4) is ended and a transition from period (4) to period (5) is made when the power-supply signal asserted on the power-supply line DS is raised from the second electric potential Vss back to the first electric potential Vcc. In period (5), the state of the pixel circuit 2 is shown in a circuit diagram of FIG. 13. As shown in this figure, with the power-supply signal on the power-supply line DS raised from the second electric potential Vss back to the first electric potential Vcc, a current is flowing from the power-supply line DS to the signal holding capacitor C1 by way of the device driving transistor T2 and electrically charging the signal holding capacitor C1. Thus, an electric potential Vs appearing on the source electrode S of the device driving transistor T2 and the anode of the light emitting device EL is also rising to a level equal to (Vofs−Vth) where reference notation Vofs denotes the reference electric potential Vofs which is appearing at the gate electrode G of the device driving transistor T2. As shown in the circuit diagram of FIG. 13, an equivalent circuit of the light emitting device EL is a parallel circuit including a diode Tel and a capacitor Cel. The reference electric potential Vofs is set at such a value that (Vofs−Vth) is smaller than (Vcat+Vthel) where reference notation Vth denotes the threshold voltage of the device driving transistor T2, reference notation Vcat denotes an electric potential appearing at the cathode of the light emitting device EL and reference notation Vthel denotes the threshold voltage of the light emitting device EL. That is to say, in period (5), the electric potential appearing on the source electrode S of the device driving transistor T2 and the anode of the light emitting device EL is lower than (Vcat+Vthel) so that the diode Tel is put in a turned-off state. Thus, a leak current is flowing through the diode Tel of the equivalent circuit of the light emitting device EL. Since the leak current is much smaller than the current flowing from the power-supply line DS to the signal holding capacitor C1 by way of the device driving transistor T2, as described above, most of the current flowing from the power-supply line DS to the signal holding capacitor C1 by way of the device driving transistor T2 is electrically charging the signal holding capacitor C1 and the capacitor Cel of the equivalent circuit of the light emitting device EL. The control signal asserted on the scan line WS is lowered from the H level back to the L level in order to put the signal sampling transistor T1 in a turned-off state so as to terminate period (5) in which the threshold-voltage compensation process is carried out.

Figure 14:
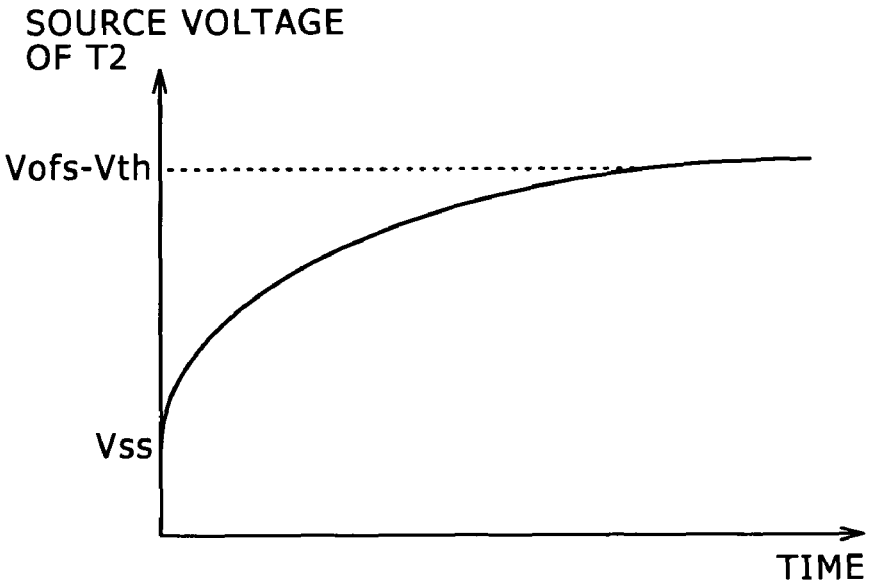
FIG. 14 is a diagram showing a graph depicting how the source electric potential appearing at the source electrode of a device driving transistor employed in the pixel circuit shown in the circuit diagram of FIG. 8 rises with the lapse of time in period (5) shown in the explanatory timing diagram of FIG. 9.
Figure 15:
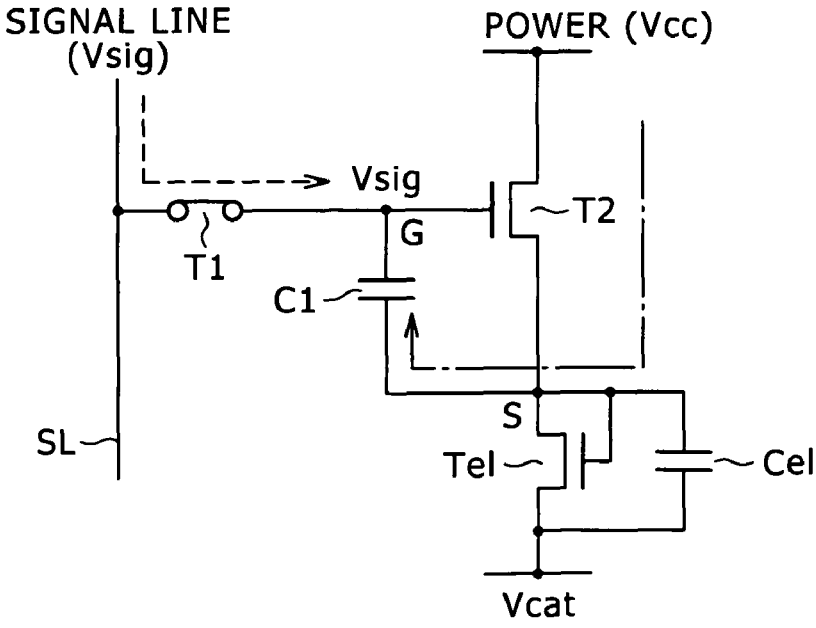
FIG. 15 is an explanatory circuit diagram to be referred to in description of operations carried out by the pixel circuit shown in the circuit diagram of FIG. 8 in period (6) shown in the explanatory timing diagram of FIG. 9.

FIG. 14 is a diagram showing a graph depicting how the source electric potential Vs appearing at the source electrode S of the device driving transistor T2 (or appearing at the anode electric potential of the light emitting device EL) rises with the lapse of time during period (5) used as the period of the threshold-voltage compensation process. As shown in the figure, the source electric potential Vs appearing at the source electrode S of the device driving transistor T2 rises from the second electric potential Vss to an electric-potential level equal to (Vofs−Vth) with the lapse of time. As the source electric potential Vs appearing at the source electrode S of the device driving transistor T2 reaches the electric-potential level equal to (Vofs−Vth), that is, as the gate-source voltage Vgs representing the difference between the gate electric potential Vg appearing at the gate electrode G of the device driving transistor T2 and the source electric potential Vs appearing at the source electrode S of the device driving transistor T2 becomes equal to a voltage corresponding to the threshold voltage Vth of the device driving transistor T2 due to the fact that the electric potential appearing at the gate electrode G of the device driving transistor T2 is fixed at the reference electric potential Vofs, the device driving transistor T2 enters a cut-off state causing a current flowing from the power-supply line DS to the signal holding capacitor C1 by way of the device driving transistor T2 ceases to flow. However, the reference electric potential Vofs is set at such a value that (Vofs−Vth) is smaller than (Vcat+Vthel).

Then, between the end of the threshold-voltage compensation period and the start of period (6), the input signal asserted on the signal line SL is raised from the reference electric potential Vofs back to the video-signal electric potential Vsig of the video signal. The video-signal electric potential Vsig is a voltage corresponding to the gradation of the pixel circuit 2. Subsequently, when the control signal asserted on the scan line WS is raised from the L level back to the H level in order to put the signal sampling transistor T1 in a turned-on state as shown a circuit diagram of FIG. 15, period (6) is started. When the signal sampling transistor T1 is put in a turned-on state, the video-signal electric potential Vsig already asserted on the signal line SL is supplied to the gate electrode G of the device driving transistor T2 by way of the signal sampling transistor T1, increasing the gate-source voltage Vgs representing the difference between the gate electric potential Vg appearing at the gate electrode G of the device driving transistor T2 and the source electric potential Vs appearing at the source electrode S of the device driving transistor T2 to a magnitude greater than the voltage corresponding to the threshold voltage Vth of the device driving transistor T2. Thus, a current is flowing from the power-supply line DS set at the first electric potential Vcc to the signal holding capacitor C1 by way of the device driving transistor T2 and electrically charging the signal holding capacitor C1 and the capacitor Cel so that the source electric potential Vs appearing at the source electrode S of the device driving transistor T2 is rising in a way similar to period (5). This is because, in period (6), the electric potential appearing on the source electrode S of the device driving transistor T2 and the anode of the light emitting device EL is still lower than (Vcat+Vthel) where reference notation Vcat denotes the electric potential appearing at the cathode of the light emitting device EL whereas reference notation Vthel denotes the threshold voltage of the light emitting device EL.

In period (6), the threshold-voltage compensation process of the device driving transistor T2 has already been completed in period (5) which leads ahead of period (6). Thus, a current flowing through the device driving transistor T2 is not affected by variations of the threshold voltage Vth of the device driving transistor T2. That is to say, the current flowing through the device driving transistor T2 reflects only the mobility μ of the device driving transistor T2. To put it more concretely, the larger the mobility μ of the device driving transistor T2, the larger the magnitude of the current flowing through the device driving transistor T2 and, the larger the magnitude of the current flowing through the device driving transistor T2, the larger the electric-potential increase ΔV by which the source electric potential Vs appearing at the source electrode S of the device driving transistor T2 is raised during period (6). Conversely, the smaller the mobility μ of the device driving transistor T2, the smaller the magnitude of the current flowing through the device driving transistor T2 and, the smaller the magnitude of the current flowing through the device driving transistor T2, the smaller the electric-potential increase ΔV by which the source electric potential Vs appearing at the source electrode S of the device driving transistor T2 is raised during period (6). The threshold-voltage compensation process is thus carried out in period (6) in order to reduce the gate-source voltage Vgs representing the difference between the gate electric potential Vg appearing at the gate electrode G of the device driving transistor T2 and the source electric potential Vs appearing at the source electrode S of the device driving transistor T2 by the electric-potential increase ΔV which reflects the mobility μ of the device driving transistor T2. As a result, a gate-source voltage Vgs obtained for the device driving transistor T2 at a point of time the threshold-voltage compensation process carried out in period (6) is completed is compensated for variations of the mobility μ of the device driving transistor T2.

Figure 16:
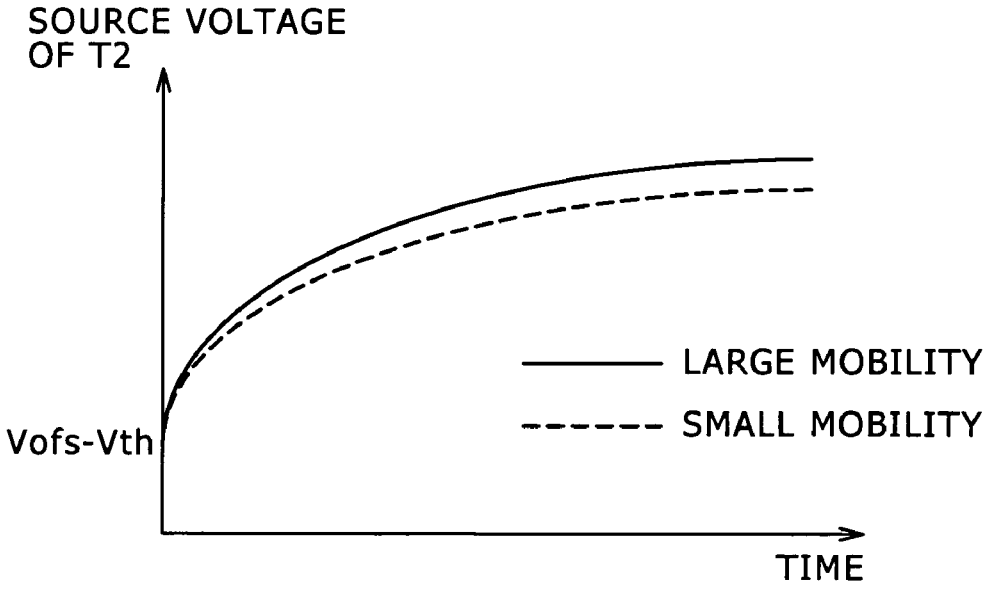
FIG. 16 is a diagram showing graphs each depicting how the source electric potential appearing at the source electrode S of a device driving transistor employed in the pixel circuit shown in the circuit diagram of FIG. 8 increases with the lapse of time in period (6) shown in the explanatory timing diagram of FIG. 9.
Figure 17:
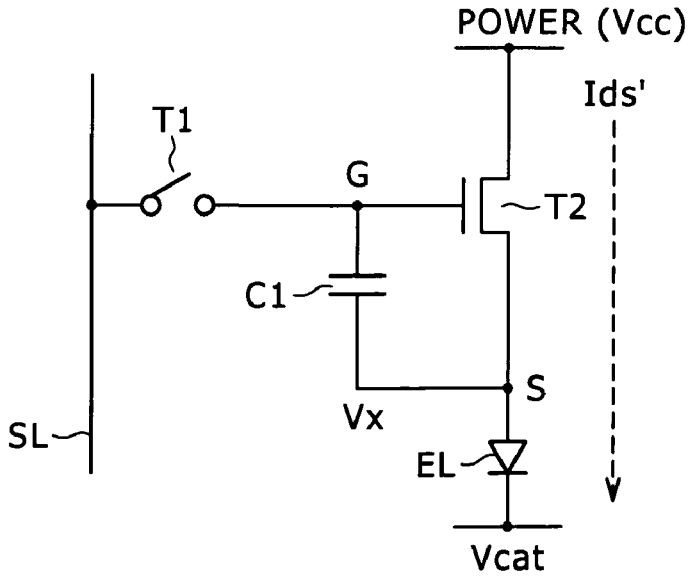
FIG. 17 is an explanatory circuit diagram to be referred to in description of operations carried out by the pixel circuit shown in the circuit diagram of FIG. 8 in period (7) shown in the explanatory timing diagram of FIG. 9.

FIG. 16 is a diagram showing graphs each depicting how the source electric potential Vs appearing at the source electrode S of the device driving transistor T2 (or appearing at the anode electric potential of the light emitting device EL) increases with the lapse of time during period (6) which is used as the period of the mobility compensation process. As shown in the figure, for a large mobility μ of the device driving transistor T2, the source electric potential Vs appearing at the source electrode S of the device driving transistor T2 increases with the lapse of time at a speed higher than the speed for a small mobility μ. Thus, for a large mobility μ of the device driving transistor T2, the gate-source voltage Vgs representing the difference between the gate electric potential Vg appearing at the gate electrode G of the device driving transistor T2 and the source electric potential Vs appearing at the source electrode S of the device driving transistor T2 is reduced by a voltage decrease which is greater than that for a small mobility μ. That is to say, the larger the mobility μ of the device driving transistor T2, the larger the voltage decrease by which the gate-source voltage Vgs of the device driving transistor T2 is reduced and, therefore, a larger voltage decrease is capable of eliminating the effect of the larger mobility μ more than a small voltage decrease does. In other words, for a large mobility μ of the device driving transistor T2, the driving current Ids is reduced more. Conversely, for a small mobility μ of the device driving transistor T2, the source electric potential Vs appearing at the source electrode S of the device driving transistor T2 increases with the lapse of time at a speed lower than the speed for a large mobility μ. Thus, for a small mobility μ of the device driving transistor T2, the gate-source voltage Vgs of the device driving transistor T2 is reduced by a voltage decrease which is smaller than that for a large mobility μ. That is to say, the smaller the mobility μ of the device driving transistor T2, the smaller the voltage decrease by which the gate-source voltage Vgs of the device driving transistor T2 is reduced and, therefore, a small voltage decrease eliminates the effect of the larger mobility μ less than a large voltage decrease does. In other words, for a small mobility μ of the device driving transistor T2, the driving current Ids is reduced less. Thus, for a small mobility μ of the device driving transistor T2, the gate-source voltage Vgs representing the difference between the gate electric potential Vg appearing at the gate electrode G of the device driving transistor T2 and the source electric potential Vs appearing at the source electrode S of the device driving transistor T2 is not reduced by a large voltage decrease so as to correct the small driving power of the small mobility μ.

As is obvious from the above description, during period (6), the video-signal electric potential Vsig is stored in the signal holding capacitor C1 in a signal write process and, at the same time, the source electric potential Vs appearing at the source electrode S of the device driving transistor T2 is raised by the electric-potential increase ΔV in a mobility compensation process. For this reason, period (6) is referred to as a joint period of the signal write process and the mobility compensation process.

Period (7) including the light emission period is started when the signal sampling transistor T1 is put in a turned-off state so that the light emitting element EL emits light. By virtue of the bootstrap operation, the gate-source voltage Vgs representing the difference between the gate electric potential Vg appearing at the gate electrode G of the device driving transistor T2 and the source electric potential Vs appearing at the source electrode S of the device driving transistor T2 is sustained at a constant value. With the gate-source voltage Vgs of the device driving transistor T2 sustained at a constant value, a driving current Ids' is flowing from the device driving transistor T2 to the light emitting device EL as a current having a constant magnitude determined by the characteristic equation given before.

During the light emission period in the later part of period (7), the light emitting device EL is emitting light. When the light emission period becomes long, however, the current-voltage characteristic of the light emitting device EL unavoidably changes. Thus, during period (7), the source electric potential Vs appearing at the source electrode S of the device driving transistor T2 may change. By virtue of the bootstrap operation, however, the gate-source voltage Vgs representing the difference between the gate electric potential Vg appearing at the gate electrode G of the device driving transistor T2 and the source electric potential Vs appearing at the source electrode S of the device driving transistor T2 is sustained at a constant value. Thus, the magnitude of the driving current Ids' flowing to the light emitting device EL does not change either. As a result, even if the current-voltage characteristic of the light emitting device EL changes, the driving current Ids' with a fixed magnitude is always flowing to the light emitting device EL so that the luminance of light emitted by the light emitting device EL also remains unchanged as well.

The active-matrix display apparatus described so far as an active-matrix display apparatus according to an embodiment of the present invention employs a flat panel which serves as the pixel array section 1. The active-matrix display apparatus can be applied to a variety of electronic instruments used in all fields to serve as the display section of each of the instruments. The display section employed in an electronic instrument is used for displaying an image or a video to represent information which is entered to the main unit of the instrument or generated in the main unit. Typical examples of the electronic instrument are a TV set, a digital still camera, a notebook personal computer, a cellular phone and a video camera. The following description explains the electronic instruments to which the active-matrix display apparatus provided by an embodiment of the present invention is applied to serve as the display section of each of the instruments.

Figure 18:
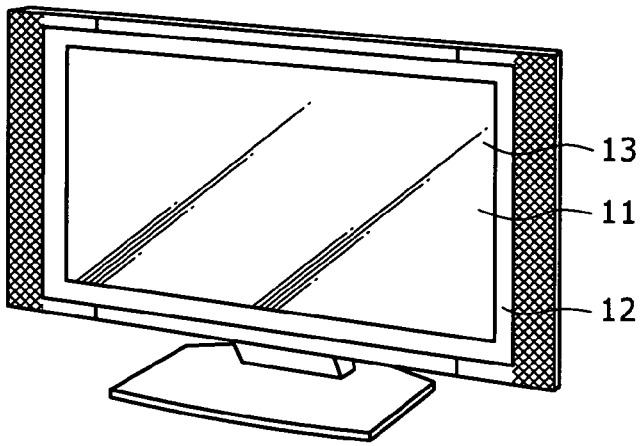
FIG. 18 is a diagram showing a typical external perspective view of an electronic instrument which functions as a TV receiver.

FIG. 18 is a diagram showing a typical perspective external view of an electronic instrument which functions as a TV receiver. As shown in the diagram of the figure, the case front face of the TV receiver includes an image display screen 11 which has a front panel 12 and a filter glass 13. The active-matrix display apparatus provided by the present invention is applied to the TV receiver to serve as the image display screen 11.

Figure 19:
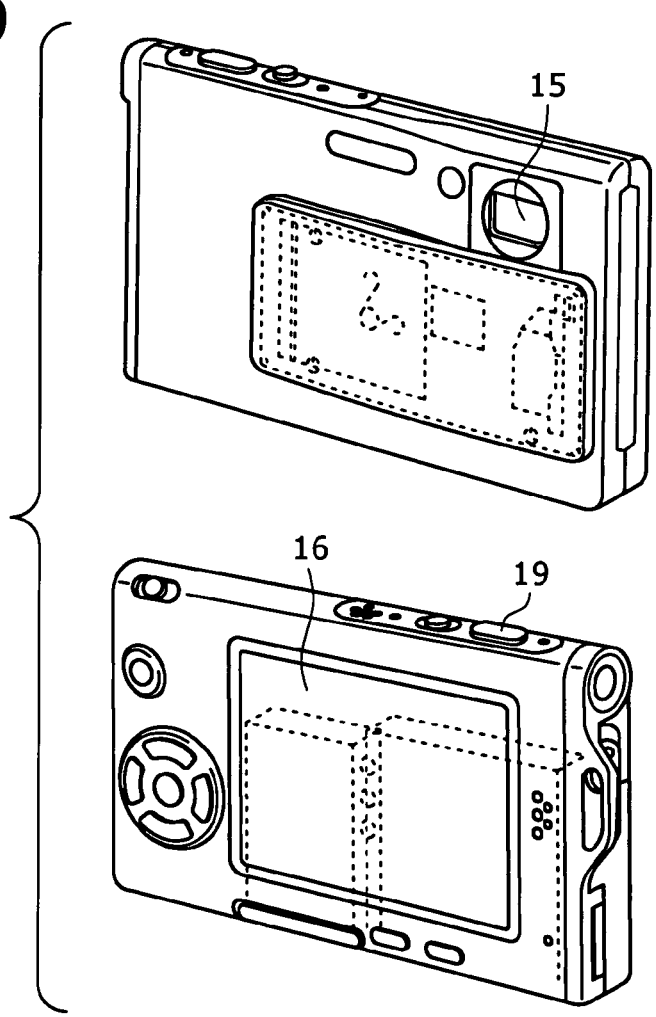
FIG. 19 is a plurality of diagrams each showing a typical perspective external view of an electronic instrument which functions as a digital still camera.

In addition, the electronic instrument may also be assumed to be a digital still camera. FIG. 19 is a plurality of diagrams each showing a typical perspective external view of the digital still camera. To be more specific, the upper figure is a diagram showing a typical external view of the front side of the digital still camera whereas the lower figure is a diagram showing a typical external view of the rear side (or the photographer side) of the digital still camera.

As shown in the diagrams of the figures, the digital still camera employs a photographing lens, a flash light emitting section 15, an image display screen 16, a control switch, a menu switch and a shutter button 19. The active-matrix display apparatus provided by an embodiment of the present invention is applied to the digital still camera to serve as the image display screen 16.

Figure 20:
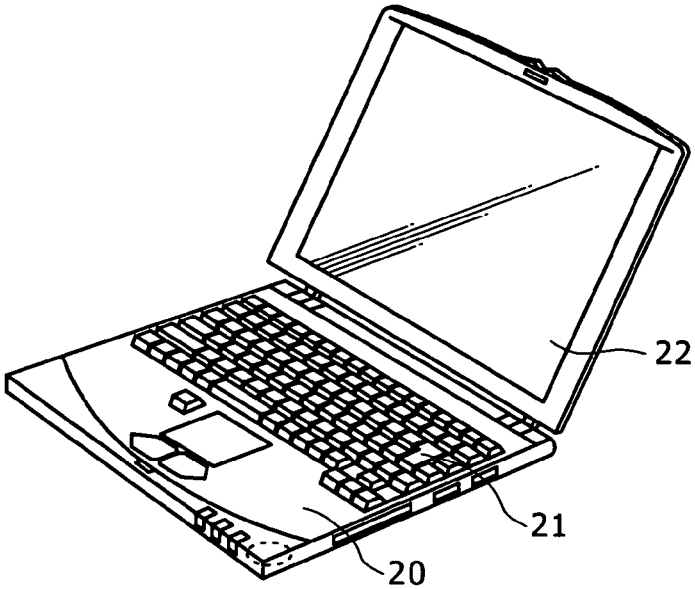
FIG. 20 is a diagram showing a typical perspective external view of an electronic instrument which functions as a notebook computer.

In addition, the electronic instrument may also be assumed to be a notebook personal computer. FIG. 20 is a diagram showing a typical perspective external view of the notebook computer.

As shown in the diagram of the figure, the notebook computer employs a main unit 20, a keyboard 21 for entering data such as characters to the main unit 20 and an image display screen 22 provided on a cover of the main unit 20 to serve as a screen for displaying an image. The active-matrix display apparatus provided by an embodiment of the present invention is applied to the notebook personal computer to serve as the image display screen 22.

Figure 21:
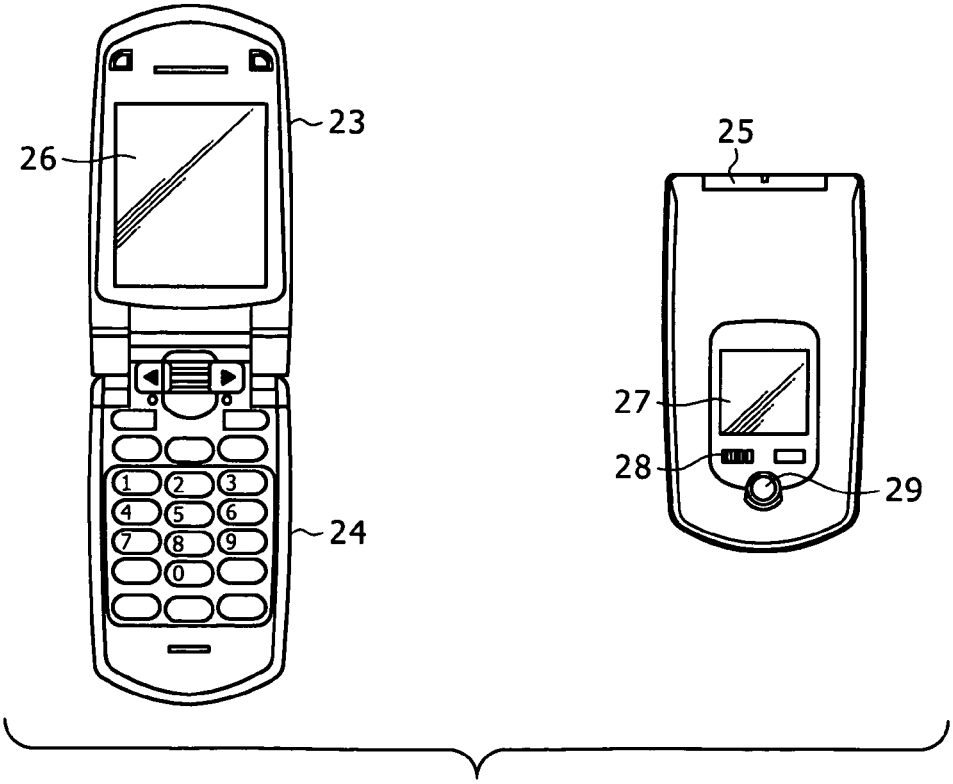
FIG. 21 is a plurality of model diagrams each showing a typical external view of an electronic instrument functioning as a portable terminal which serves as a cellular phone of a fold-back type.

In addition, the electronic instrument may also be assumed to be a portable terminal. FIG. 21 is a plurality of model diagrams each showing a typical external view of the portable terminal which serves as a cellular phone of a fold-back type. To be more specific, the left figure is a diagram showing a typical external view of the cellular phone with a case thereof opened whereas right figure is a diagram showing a typical external view of the cellular phone with the case folded back.

As shown in the diagrams of the figures, the cellular phone employs an upper case 23, a lower case 24, a link section 25, an image display screen 26, an auxiliary image display screen 27, a picture light 28 and a camera 29. In the case of this cellular phone, the link section is a hinge connecting the upper case 23 and the lower case 24 to each other. The active-matrix display apparatus provided by an embodiment of the present invention is applied to the cellular phone to serve as the image display screen 26 and the auxiliary image display screen 27.

Figure 22:
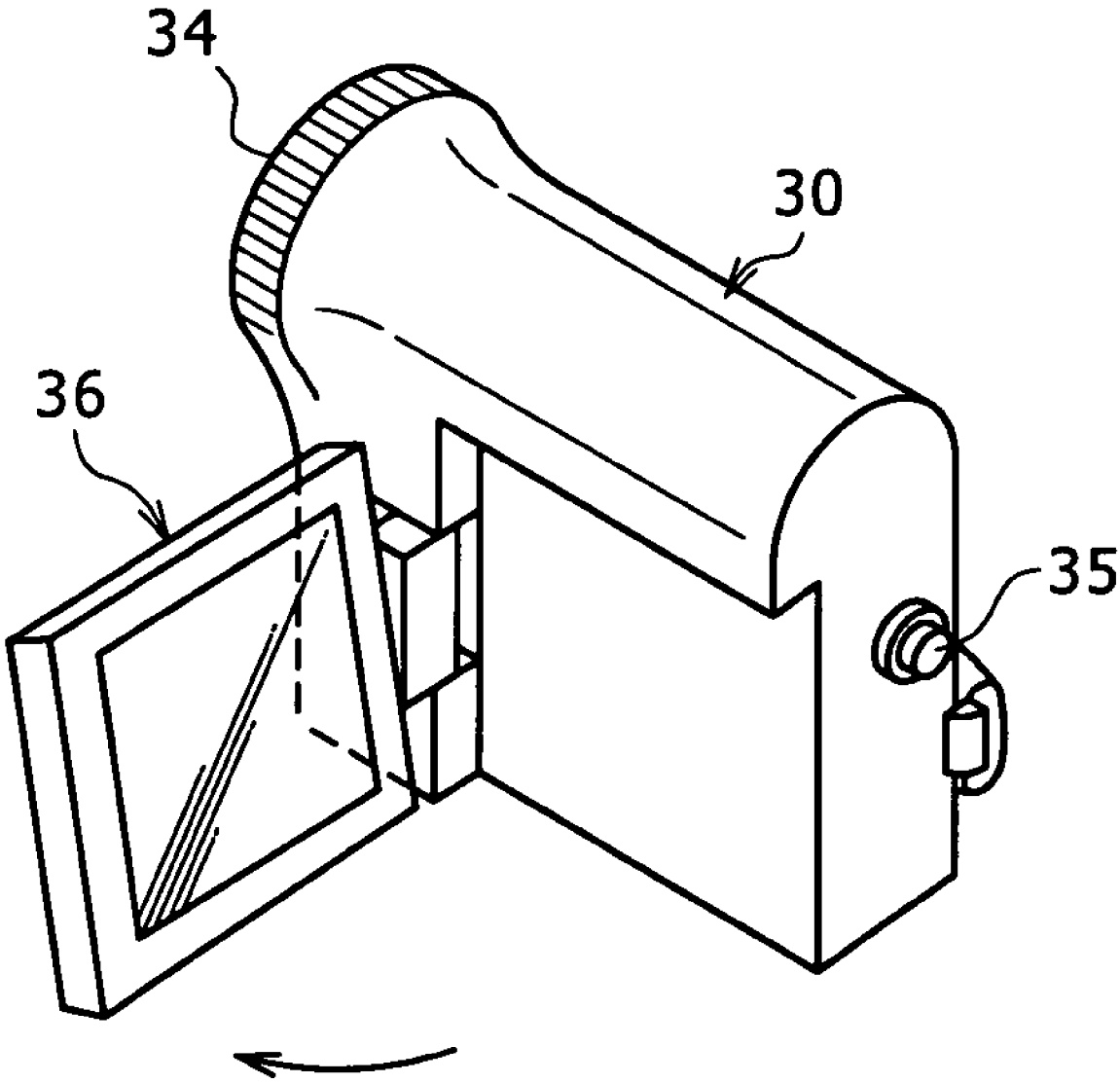
FIG. 22 is a diagram showing a typical perspective external view of an electronic instrument which functions as a video camera.

In addition, the electronic instrument may also be assumed to be a video camera. FIG. 22 is a diagram showing a typical perspective external view of the video camera.

As shown in the diagram of the figure, the video camera includes a main unit 30, an image-taking lens 34, a photographing start/stop switch 35 and a monitor 36. The image-taking lens 34 is provided on the main unit 30 to serve as a lens for taking an image of a subject of video photographing. The active-matrix display apparatus provided by an embodiment of the present invention is applied to the video camera to serve as the monitor 36.

The present application contains subject matter related to that disclosed in Japanese Priority Patent Application JP 2008-194343 filed in the Japan Patent Office on Jul. 29, 2008, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. An electronic instrument comprising:

main unit means; and display means for displaying information supplied to said main unit means and information output by said main unit means, wherein said display means is provided with scan lines, signal lines, and pixel circuits, said scan lines, said signal lines, and said pixel circuits are laid out to form a two-dimensional matrix of a pixel array section, said scan lines each forming a row of said two-dimensional matrix are each used for supplying a control signal to said pixel circuits, said signal lines each forming a column of said two-dimensional matrix are each used for supplying a video signal to said pixel circuits, each of said pixel circuits is located at the intersection of one of said scan lines and one of said signal lines, said scan lines, said signal lines and said pixel circuits are formed on a substrate, each of said pixel circuits has a signal sampling transistor for sampling said video signal with a timing determined by said control signal, a device driving transistor for generating a driving current with a magnitude according to said video signal sampled by said signal sampling transistor, a signal holding capacitor for storing said video signal sampled by said signal sampling transistor, a light emitting device for receiving said driving current from said device driving transistor and emitting light at a luminance level according to said driving current which is determined by said video signal sampled by said signal sampling transistor, said light emitting device is a thin-film device having two terminals serving as a pair of electrodes which are referred to as an anode and a cathode, said light emitting device also includes a light emitting layer which is sandwiched by said anode and said cathode, at least one of said two electrodes are divided into N portions so that said light emitting device is virtually divided into N light emitting sub-devices, said N light emitting sub-devices receive said driving current from said device driving transistor and, as a whole, emit light at a luminance level according to said driving current which is determined by said video signal sampled by said signal sampling transistor, and if any particular one of said N light emitting sub-devices pertaining to any specific one of said pixel circuits is defective, said particular light emitting sub-device is electrically disconnected from said specific pixel circuit and the magnitude of said driving current supplied to said (N−1) remaining light emitting sub-devices pertaining to said specific pixel circuit is adjusted so that said (N−1) remaining light emitting sub-devices receive a driving current from said device driving transistor with a magnitude suppressed to a value equal to ((N−1)/N) times the magnitude of a driving current which is supplied to a normal pixel circuit not including a defective light emitting sub-device.

2. An electronic instrument comprising:

a main unit section; and a display section configured to display information supplied to said main unit section and information output by said main unit section, wherein said display section is provided with scan lines, signal lines, and pixel circuits, said scan lines, said signal lines, and said pixel circuits are laid out to form a two-dimensional matrix of a pixel array section, said scan lines each forming a row of said two-dimensional matrix are each used for supplying a control signal to said pixel circuits, said signal lines each forming a column of said two-dimensional matrix are each used for supplying a video signal to said pixel circuits, each of said pixel circuits is located at the intersection of one of said scan lines and one of said signal lines, said scan lines, said signal lines and said pixel circuits are formed on a substrate, each of said pixel circuits has a signal sampling transistor for sampling said video signal with a timing determined by said control signal, a device driving transistor for generating a driving current with a magnitude according to said video signal sampled by said signal sampling transistor, a signal holding capacitor for storing said video signal sampled by said signal sampling transistor, a light emitting device for receiving said driving current from said device driving transistor and emitting light at a luminance level according to said driving current which is determined by said video signal sampled by said signal sampling transistor, said light emitting device is a thin-film device having two terminals serving as a pair of electrodes which are referred to as an anode and a cathode, said light emitting device also includes a light emitting layer which is sandwiched by said anode and said cathode, at least one of said two electrodes are divided into N portions so that said light emitting device is virtually divided into N light emitting sub-devices, said N light emitting sub-devices receive said driving current from said device driving transistor and, as a whole, emit light at a luminance level according to said driving current which is determined by said video signal sampled by said signal sampling transistor, and if any particular one of said N light emitting sub-devices pertaining to any specific one of said pixel circuits is defective, said particular light emitting sub-device is electrically disconnected from said specific pixel circuit and the magnitude of said driving current supplied to said (N−1) remaining light emitting sub-devices pertaining to said specific pixel circuit is adjusted so that said (N−1) remaining light emitting sub-devices receive a driving current from said device driving transistor with a magnitude suppressed to a value equal to ((N−1)/N) times the magnitude of a driving current which is supplied to a normal pixel circuit not including a defective light emitting sub-device.

3. An active-matrix display apparatus comprising:

scan lines;

signal lines; and pixel circuits, wherein said scan lines, said signal lines and said pixel circuits are laid out to form a two-dimensional matrix of a pixel array section, said scan lines each forming a row of said two-dimensional matrix are each used for supplying a control signal to said pixel circuits, said signal lines each forming a column of said two-dimensional matrix are each used for supplying a video signal to said pixel circuits, each of said pixel circuits is located at the intersection of one of said scan lines and one of said signal lines, said scan lines, said signal lines and said pixel circuits are formed on a substrate, each of said pixel circuits has a signal sampling transistor for sampling said video signal with a timing determined by said control signal, a device driving transistor for generating a driving current with a magnitude according to said video signal sampled by said signal sampling transistor, a signal holding capacitor for storing said video signal sampled by said signal sampling transistor, and a light emitting device for receiving said driving current from said device driving transistor and emitting light at a luminance level according to said driving current which is determined by said video signal sampled by said signal sampling transistor, said light emitting device is a thin-film device having two terminals serving as a pair of electrodes which are referred to as an anode and a cathode, said light emitting device also includes a light emitting layer which is sandwiched by said anode and said cathode, at least one of said two electrodes are divided into N portions so that said light emitting device is virtually divided into N light emitting sub-devices, said N light emitting sub-devices receive said driving current from said device driving transistor and, as a whole, emit light at a luminance level according to said driving current which is determined by said video signal sampled by said signal sampling transistor, and if any particular one of said N light emitting sub-devices pertaining to any specific one of said pixel circuits is defective, said particular light emitting sub-device is electrically disconnected from said specific pixel circuit and the magnitude of said driving current supplied to said (N−1) remaining light emitting sub-devices pertaining to said specific pixel circuit is adjusted so that said (N−1) remaining light emitting sub-devices receive a driving current from said device driving transistor with a magnitude suppressed to a value equal to ((N−1)/N) times the magnitude of a driving current which is supplied to a normal pixel circuit not including a defective light emitting sub-device.

4. The active-matrix display apparatus according to claim 3 wherein:

said active-matrix display apparatus is provided with a signal driver for asserting said video signal on each of said signal lines; and said signal driver controls the level of said video signal to be asserted on said signal line and to be latched in said specific pixel circuit including a defective light emitting sub-device already electrically disconnected from said specific pixel circuit so that said (N−1) remaining light emitting sub-devices of said specific pixel circuit receive a driving current from said device driving transistor with a magnitude suppressed to a value equal to ((N−1)/N) times the magnitude of a driving current which is supplied to a normal pixel circuit not including a defective light emitting sub-device.

5. A method for driving an active-matrix display apparatus comprising:

scan lines;

signal lines; and pixel circuits, wherein said scan lines, said signal lines, and said pixel circuits are laid out to form a two-dimensional matrix of a pixel array section, said scan lines each forming a row of said two-dimensional matrix are each used for supplying a control signal to said pixel circuits, said signal lines each forming a column of said two-dimensional matrix are each used for supplying a video signal to said pixel circuits, each of said pixel circuits is located at the intersection of one of said scan lines and one of said signal lines, said scan lines, said signal lines and said pixel circuits are formed on a substrate, each of said pixel circuits has a signal sampling transistor for sampling said video signal with a timing determined by said control signal, a device driving transistor for generating a driving current with a magnitude according to said video signal sampled by said signal sampling transistor, a signal holding capacitor for storing said video signal sampled by said signal sampling transistor, and a light emitting device for receiving said driving current from said device driving transistor and emitting light at a luminance level according to said driving current which is determined by said video signal sampled by said signal sampling transistor, said light emitting device is a thin-film device having two terminals serving as a pair of electrodes which are referred to as an anode and a cathode, said light emitting device also includes a light emitting layer which is sandwiched by said anode and said cathode, at least one of said two-electrodes are divided into N portions so that said light emitting device is virtually divided into N light emitting sub-devices, and said N light emitting sub-devices receive said driving current from said device driving transistor and, as a whole, emit light at a luminance level according to said driving current which is determined by said video signal sampled by said signal sampling transistor, said method executed so that, if any particular one of said N light emitting sub-devices pertaining to any specific one of said pixel circuits is defective, said particular light emitting sub-device is electrically disconnected from said specific pixel circuit and the magnitude of said driving current supplied to said (N−1) remaining light emitting sub-devices pertaining to said specific pixel circuit is adjusted so that said (N−1) remaining light emitting sub-devices receive a driving current from said device driving transistor with a magnitude suppressed to a value equal to ((N−1)/N) times the magnitude of a driving current which is supplied to a normal pixel circuit not including a defective light emitting sub-device.

* * * * *